United States Patent [19]

Kato et al.

[11] Patent Number: 4,971,870

[45] Date of Patent: Nov. 20, 1990

[54] ELECTROPHOTOGRAPHIC LITHOGRAPHIC PRINTING PLATE PRECURSOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 337,790

[22] Filed: Apr. 13, 1989

[51] Int. Cl.[5] ..... G03G 5/087

[52] U.S. Cl. ..... 430/49; 430/87

[58] Field of Search ..... 430/87, 49, 96

[56] References Cited

U.S. PATENT DOCUMENTS 4,792,511 12/1988 Kato et al. ..... 430/87

4,828,952 5/1989 Kato et al. ..... 430/87

*Primary Examiner*—John L. Goodrow

*Attorney, Agent, or Firm*—Sughrue, Mion, Zinn, Macpeak & Seas

[57] ABSTRACT

A lithographic printing plate precursor excellent in oil-desensitivity, whereby an original is faithfully reproduced without occurrence of overall or spotted stains as an offset master is provided, which comprises an electrically conductive support and at least one photoconductive layer, provided thereon, containing photoconductive zinc oxide and a binder resin, in which said photoconductive layer contains resin grains containing at least one polymeric component or repeating unit containing at least one functional group capable of producing at least one polar group through decomposition.

15 Claims, No Drawings

ELECTROPHOTOGRAPHIC LITHOGRAPHIC PRINTING PLATE PRECURSOR

BACKGROUND OF THE INVENTION

1. Field of the Invention

This invention relates to an electrophotographic lithographic printing plate precursor made by an electrophotographic system and more particularly, it is concerned with an improvement in a photoconductive layer forming composition for the lithographic printing plate precursor.

2. Description of the Prior Art

A number of offset masters for directly producing printing plates have hitherto been proposed and some of them have already been put into practical use. Widely employed among them is a system in which a photoreceptor comprising a conductive support having provided thereon a photoconductive layer mainly comprising photoconductive particles, for example, of zinc oxide and a resin binder is subjected to an ordinary elecrophotographic processing to form a highly lipophilic toner image on the surface of the photoreceptor, followed by treating the surface with an oil-desensitizing solution referred to as an etching solution to selectively render non-image areas hydrophilic and thus obtain an offset printing plate.

Requirements of offset masters for obtaining satisfactory prints include: (1) an original should be reproduced faithfully on the photoreceptor; (2) the surface of the photoreceptor has affinity with an oil-desensitizing solution so as to render non-image areas sufficiently hydrophilic, but, at the same time, has resistance to solubilization; and (3) a photoconductive layer having an image formed thereon is not released during printing and is well receptive to dampening water so that the non-image areas retain the hydrophilic properties sufficiently to be free from stains even upon printing a large number of prints.

It is known that these properties are affected by the ratio of zinc oxide to a resin binder in the photoconductive layer. For example, if the ratio of a binder resin to zinc oxide particles is decreased, oil-desensitivity of the surface of the photoconductive layer is increased to reduce background stains, but, on the other hand, the internal cohesion of the photoconductive layer per se is weakened, resulting in reduction of printing durability due to insufficient mechanical strength. If the ratio of a binder resin to zinc oxide particles is increased, on the other hand, printing durability is improved, but background staining becomes conspicuous. It is a matter of course that the background staining is a phenomenon associated with the degree of oil-desensitization achieved and it has been made apparent that the oil-desensitization of the photoconductive layer surface depends on not only the binder resin/zinc oxide ratio in the photoconductive layer, but also the kind of the binder resin used to a great extent.

Resin binders which have been conventionally known include silicone resins (see Japanese Patent Publication No. 6670/1959), styrene-butadiene resins (see Japanese Patent Publication No. 1950/1960), alkyd resins, maleic acid resins, polyamides (see Japanese Patent Publication No. 11219/1960), vinyl acetate resins (see Japanese Patent Publication No. 2425/1966), vinyl acetate copolymer resins (see Japanese Patent Publication No. 2426/1966), acrylic resins (see Japanese Patent Publication No. 11216/1960), acrylic ester copolymer resins (see Japanese Patent Publication Nos. 11219/1960, 8510/1961, and 13946/1966), etc. However, electrophotographic light-sensitive material using these known resins suffer from one or more of several disadvantages, such as (1) low charging characteristics of the photoconductive layer, (2) poor quality of a reproduced image (particularly dot reproducibility or resolving power), (3) low sensitivity to exposure; (4) insufficient oil-desensitization attained by oil-desensitization for use as an offset master (which results in background stains on prints when used for offset printing), (5) in sufficient film strength of the light-sensitive layer (which causes release of the light-sensitive layer during offset printing and failure to obtain a large number of prints), (6) susceptibility of image quality to influences of environment at the time of electrophotographic image formation (such as high temperature and high humidity), and the like.

For particular use as an offset master, occurrence of background stains due to insufficient oil-desensitivity presents a serious problem. In order to solve this problem, various resins for binding zinc oxide have been proposed, including resins of $\overline{M}w$ $1.8-10\times10^{-4}$ and Tg 10°80° C. obtained by copolymerizing (meth)acrylate monomers and other monomers in the presence of fumaric acid in combination with copolymers of (meth)acrylate monomers and other monomers than fumaric acid, as disclosed in Japanese Patent Publication No. 31011/1975; terpolymers each containing a (meth)acrylic acid ester unit having a substituent having carboxylic acid group at least 7 atoms distant from the ester linkage, as disclosed in Japanese Patent Laid-Open Publication No. 54027/1978; tetra- or pentamers each containing an acrylic acid unit and hydroxyethyl (meth)acrylate unit, as disclosed in Japanese Patent Laid-Open Publication Nos. 20735/1979 and 202544/1982; terpolymers each containing a (meth)acrylic acid ester unit having an alkyl group having 6 to 12 carbon atoms as a substituent and a vinyl monomer containing carboxylic acid group, as disclosed in Japanese Patent Laid-Open Publication No. 68046/1983; and the like. These resins function to improve the oil-desensitivity of photoconductive layers.

Nevertheless, evaluation of such resins as noted above for improving the oil-desensitization indicate that none of them is completely satisfactory in terms of stain resistance, printing durability and the like.

Furthermore, it has hitherto been studied to use resins having functional groups capable of forming hydrophilic groups through decomposition as such a binder resin, for example, those having functional groups capable of forming hydroxyl groups as disclosed in Japanese Patent Laid-Open Publication Nos. 195684/1987, 210475/1987 and 210476/1987 and those having functional groups capable of forming carboxyl groups as disclosed in Japanese Patent Laid-Open Publication No. 212669/1987.

These resins are those which form hydrophilic groups through hydrolysis or hydrogenolysis with an oil-desensitizing solution or dampening water used during printing. When using them as a binder resin for a lithographic printing plate precursor, it is possible to avoid various problems, e.g., deterioration of smoothness, deterioration of electrophotographic properties such as dark charge retention and photosensitivity, etc., which are considered to be caused by strong interaction of the hydrophilic groups and surfaces of photoconductive zinc oxide particles in the case of using resins intrinsically having hydrophilic groups per se, and at the same time, a number of prints with clear image quality and without background stains can be obtained, since the hydrophilic property of non-image areas rendered hydrophilic with an oil-desensitizing solution if further increased by the above described hydrophilic groups formed through decomposition in the resin to make clear the lipophilic property of image areas and the hydrophilic property of non-image areas and to prevent the non-image areas from adhesion of a printing ink during printing.

At the present time, in the electrophotographic lithographic printing, a higher efficiency has been required and in particular, it has been required to increase the speeds of plate making and etching.

For such requirements is insufficient the above proposed offset printing plate using the binder resin capable of forming hydrophilic groups through decomposition with respect to the problems of increasing the etching speed and reducing the loss of prints.

Furthermore, none of these resins are completely satisfactory in terms of stain resistance, printing durability, and the like. Even when using the above described resins containing functional groups capable of forming hydrophilic groups, increase of the contents thereof for the purpose of further improving the hydrophilic property of non-image areas results in the improvement of the hydrophilic property by the hydrophilic groups formed through decomposition, which rather renders the non-image areas water-soluble and thus presents a problem on durability.

Therefore, it has eagerly been desired to develop such a new technique that the effect due to the hydrophilic property of non-image areas can further be improved while simultaneously maintaining the durability.

SUMMARY OF THE INVENTION

It is an object of the present invention to provide an electrophotographic lithographic printing plate precursor, whereby the disadvantages of the prior art, as described above, can be overcome.

It is another object of the present invention to provide a lithographic printing plate precursor excellent in oil-desensitivity, whereby an original is faithfully reproduced without occurrence of overall or spotted stains as an offset master.

It is a further object of the present invention to provide a lithographic printing plate with a high printing durability, in which the hydrophilic property of non-image areas is sufficiently held to prevent occurrence of background stains even if the steps of from etching to printing are speeded up.

These objects can be attained by an electrophotographic lithographic printing plate precursor comprising a conductive support and at least one photoconductive layer, provided thereon, containing photoconductive zinc oxide and a binder resin, wherein said photoconductive layer contains resin grains containing at least one polymeric component or repeating unit containing at least one functional group capable of producing at least one polar group through decomposition.

DETAILED DESCRIPTION OF THE INVENTION

In the present invention, the above described resin grains are preferably dispersed in the photoconductive layer, independently of the binder resin, in the form of grains whose average grain diameter is same as or smaller than the maximum grain diameter of the photoconductive zinc oxide grains.

In the present invention, the above described resin grains or particles are preferably used in a proportion of 0.1 to 50% by weight, preferably 0.5 to 20% by weight to 100 parts by weight of photoconductive zinc oxide, since if the resin grains are less than 0.1% by weight, the hydrophilic property of non-image areas does not become sufficient, while if more than 50% by weight, the hydrophilic property of non-image areas is further improved, but electrophotographic properties and reproduced images are deteriorated. During the same time, the above described binder resin is generally used in a proportion of 10 to 60% by weight, preferably 15 to 40% by weight to 100 parts by weight of the zinc oxide.

The precursor of the present invention is subjected to an etching treatment whereby non-image areas are oil-desensitized and thus rendered hydrophilic, after corona discharge, exposure and development as in the ordinary electrophotographic lithographic printing plate precursor.

The functional groups of the resin present in non-image areas are decomposed into polar groups, i.e., hydrophilic groups by an oil-desensitizing solution during the etching treatment or dampening water during printing. The hydrophilic property of the non-image areas are rendered sufficient by the hydrophilic groups and a print of clear image quality without background stains during printing can be obtained.

Since the resin containing the functional groups, as described above, is used independently of the binder resin and a smaller amount of it is dispersed in granular state, the specific area becomes larger than dispersed in molecular state and contact or reaction of the binder resin with an oil-desensitizing solution is not hindered, so that even if increasing the etching speed, the oil-desensitization of non-image areas can be rendered sufficient.

If there are the resin grains having larger grain diameters in the photoconductive layer than the photoconductive zinc oxide grains, the electrophotographic properties are deteriorated and in particular, uniform static charge property cannot be obtained, thus resulting in density unevenness in an image area, disappearance of letters or fine lines and background staining in a non-image area in a reproduced image.

In a preferred embodiment of the present invention, therefore, the resin grains are dispersed in the photoconductive layer with a grain diameter of same as or smaller than the maximum grain diameter of the photoconductive zinc oxide grains, as described above.

Specifically, the resin grains of the present invention have a maximum grain diameter of at most 10 μm, preferably at most 5 μm and an average grain diameter of at most 1.0 μm, preferably at most 0.5 μm. The specific surface areas of the resin grains are increased with the decrease of the grain diameter, resulting in good electrophotographic properties, and the grain size of colloidal grains, i.e., about 0.01 μm or smaller is sufficient. However, very small grains cause the similar troubles to those in the case of molecular dispersion and accordingly a grain size of 0.005 μm or larger is preferable. On the other hand, zinc oxide has generally a grain diameter of 0.05 to 10 μm, preferably 0.1 to 5 μm.

Thus, the lithographic printing plate precursor of the present invention has various advantages that an image faithful to an original can be reproduced without occurrence of background stains owing to the high hydrophilic property of non-image areas, the smoothness and electrostatic characteristics of the photoconductive layer are excellent and furthermore, the durability is improved. In addition, the lithographic printing plate precursor of the present invention is not sensitive to environmental influences during plate making and is stable for storage therebefore.

Resins containing at least one polymeric component or repeating unit containing at least one functional group capable of producing at least one polar group through decomposition (which will hereinafter be referred to as "resins containing polar group-producing functional groups"), at least a part of which is optionally crosslinked and which can be used in the present invention, will be illustrated in detail below:

Functional groups contained in the resins to be used in the present invention produce polar groups through decomposition and one of more polar groups may be produced from one functional group. In preferred embodiments of the present invention, the polar groups include carboxyl group, hydroxyl group, thiol group, phosphono group, amino group and sulfo group, and the like.

In accordance with a first preferred embodiment of this invention, the resins containing carboxyl group-producing functional groups are those containing at least one kind of functional group represented by formula (I):

$$-COO-L_1 \qquad (I)$$

In the foregoing formula $-COO-L_1$, $L_1$ represents

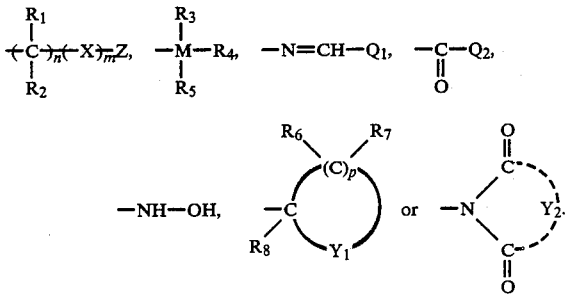

Therein, $R_1$ and $R_2$ (which may be the same or different) each represents a hydrogen atom or an aliphatic group; X represents an aromatic group; Z represents a hydrogen atom, a halogen atom, a trihalomethyl group, an alkyl group, —CN, $-NO_2$, $-SO_2R_{1'}$ (wherein $R_{1'}$ represents a hydrocarbon group, $-COOR_{2'}$ (wherein $R_{2'}$ represents a hydrocarbon group), or $-O-R_{3'}$ (wherein $R_{3'}$ represents a hydrocarbon group); n and m are each 0, 1, or 2; $R_3$, $R_4$, and $R_5$ (which may be the same or different) each represents a hydrocarbon group, or $-O-R_{4'}$ (wherein $R_{4'}$ represents a hydrocarbon group; M represents Si, Sn, or Ti; $Q_1$ and $Q_2$ each represent a hydrocarbon group; $Y_1$ represents an oxygen atom, or a sulfur atom; $R_6$, $R_7$, and $R_8$ (which may be the same or different) each represents a hydrogen atom, a hydrocarbon group; or $-O-R_{5'}$ (wherein $R_{5'}$ represents a hydrocarbon group); p represents an integer of 3 to 6; and $Y_2$ represents an organic residue to complete a cyclic imido group.

The above-described hydrocarbon group means an aliphatic group including a chain or cyclic alkyl, alkenyl or aralkyl group, and an aromatic group including a phenyl or naphthyl group, and these hydrocarbons may be substituted.

The functional groups of formula $-COO-L_1$, which produce a carboxyl group through decomposition, are described in greater detail below.

In one case where $L_1$ represents

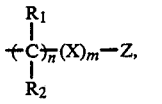

$R_1$ and $R_2$ (which may be the same or different) each preferably represents a hydrogen atom, or an optionally substituted straight or branched chain alkyl group containing 1 to 12 carbon atoms (e.g., methyl, ethyl, propyl, chloromethyl, dichloromethyl, trichloromethyl, trifluoromethyl, butyl, hexyl, octyl, decyl, hydroxyethyl, 3-chloropropyl); X preferably represents an optionally substituted phenyl or naphthyl group (e.g., phenyl, methylphenyl, chlorophenyl, dimethylphenyl, chloromethylphenyl, naphthyl); Z preferably represents a hydrogen atom, a halogen atom (e.g., chlorine, fluorine), a trihalomethyl group (e.g., trichloromethyl, trifluoromethyl), an optionally substituted straight- or branched-chain alkyl group containing 1 to 12 carbon atoms (e.g., methyl, chloromethyl, dichloromethyl, ethyl, propyl, butyl, hexyl, tetrafluoroethyl, octyl, cyanoethyl, chloroethyl), —CN, $-NO_2$, $-SO_2R_{1'}$ [where $R_{1'}$ represents an aliphatic group (e.g., an optionally substituted alkyl group having 1 to 12 carbon atoms, including methyl, ethyl, propyl, butyl, chloroethyl, pentyl, octyl, etc.; an optionally substituted aralkyl group containing from 7 to 12 carbon atoms, including benzyl, phenetyl, chlorobenzyl, methoxybenzyl, chlorophenethl, methylphenetyl, etc.); or an aromatic group (e.g., an optionally substituted phenyl or naphthyl group, including phenyl, chlorophenyl, dichlorophenyl, methylphenyl, methoxyphenyl, acetylphenyl, acetamidophenyl, methoxycarbonylphenyl, naphthyl, etc.)], $-COOR_{2'}$ (wherein $R_{2'}$ has the same meaning as $R_{1'}$); or $-O-R_{3'}$ (wherein $R_{3'}$ has the same meaning as $R_{1'}$); and n and m each represents 0, 1, or 2.

In the case where $L_1$ represents

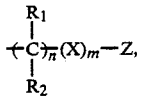

specific examples of such a substituent group include β,β,β-trichloroethyl group, β,β,β-trifluoroethyl group, hexafluoro-iso-propyl group, groups of the formula $-CH_2-(CF_2CF_2)_{n'}H$ (n'=1–5), 2-cyanoethyl group, 2-nitroethyl group, 2-methanesulfonylethyl group, 2-ethanesulfonylethyl group, 2-butanesulfonylethyl group, benzenesulfonylethyl group, 4-nitrobenzenesulfonylethyl group, 4-cyanobenzenesulfonylethyl group, 4-methylbenzenesulfonylethyl group, unsubstituted and substituted benzyl groups (e.g., benzyl, methoxybenzyl, trimethylbenzyl, pentamethylbenzyl, nitrobenzyl), unsubstituted and substituted phenacyl groups (e.g., phenacyl, bromophenacyl), and unsubstituted and substituted phenyl groups (e.g., phenyl, nitrophenyl, cyanophenyl, methanesulfonylphenyl, trifluoromethylphenyl, dinitrophenyl).

In the case where $L_1$ represents

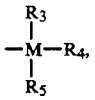

$R_3$, $R_4$, and $R_5$ (which may be the same or different) each preferably represents an optionally substituted aliphatic group containing 1 to 18 carbon atoms [wherein the aliphatic group includes an alkyl group, an alkenyl group, an aralkyl group and an alicyclic group, which each may be substituted, e.g., by a halogen atom, —CN, —OH, —O—Q' (wherein Q' represents an alkyl group, an aralkyl group, an alicyclic group, or an aryl group), etc.], an optionally substituted aromatic group containing 6 to 18 carbon atoms (e.g., phenyl, tolyl, chlorophenyl, methoxyphenyl, acetamidophenyl, naphthyl), or —O—$R_{4'}$ (wherein $R_{4'}$ represents an optionally substituted alkyl group containing 1 to 12 carbon atoms, an optionally substituted alkenyl group containing 2 to 12 carbon atoms, an optionally substituted aralkyl group containing 7 to 12 carbon atoms, an optionally substituted alicyclic group containing 5 to 18 carbon atoms, or an optionally substituted aryl group containing 6 to 18 carbon atoms); and M represents Si, Ti, or Sn, preferably Si.

In other cases where $L_1$ represents —N=CH—$Q_1$ or —CO—$Q_2$, $Q_1$ and $Q_2$ each represents, preferably, an optionally substituted aliphatic group containing 1 to 18 carbon atoms (wherein the aliphatic group include an alkyl group, an alkenyl group, an aralkyl group and an alicyclic group, which each may be substituted, e.g., by a halogen atom, —CN, an alkoxy group, etc.), or an optionally substituted aryl group containing 6 to 18 carbon atoms (e.g., phenyl, methoxyphenyl, tolyl, chlorophenyl, naphthyl).

In still another case wherein $L_1$ represents

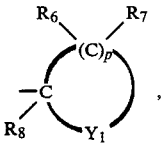

$Y_1$ represents an oxygen atom, or a sulfur atom; $R_6$, $R_7$ and $R_8$ may be the same or different, and each preferably represents a hydrogen atom, an optionally substituted straight- or branched-chain alkyl group containing 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicylic group (e.g., cyclopentyl, cyclohexyl), an optionally substituted aralkyl group containing 7 to 12 carbon atoms (e.g., benzyl, phenetyl, chlorobenzyl, methoxybenzyl), an optionally substituted aromatic group (e.g., phenyl, naphthyl, chlorophenyl, tolyl, methoxyphenyl, methoxycarbonylphenyl, dichlorophenyl), or —O—$R_{5'}$ (wherein $R_{5'}$ represents a hydrocarbon group, including the same groups as those cited as examples of $R_6$, $R_7$, and $R_8$); and p represents an integer of 3 to 6.

In a further case where $L_1$ represents

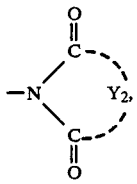

$Y_2$ represents an organic group completing a cyclic imido group. Preferred examples of such a group include those represented by the following formulae (II) and (III).

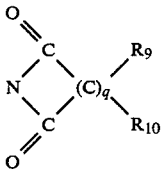

(II)

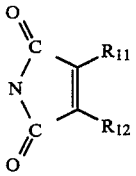

(III)

In formula (II), $R_9$ and $R_{10}$ (which may be the same or different) each represents a hydrogen atom, a halogen atom (e.g., chlorine, bromine), an optionally substituted alkyl group containing 1 to 18 carbon atoms (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, 2-(ethoxyoxy)ethyl), an optionally substituted aralkyl group containing 7 to 12 carbon atoms (e.g., benzyl, phenetyl, 3-phenylpropyl, methylbenzyl, dimethylbenzyl, methoxybenzyl, chlorobenzyl, bromobenzyl), an optionally substituted alkenyl group containing 3 to 18 carbon atoms (e.g., allyl, 3-methyl-2-propenyl, 2-hexenyl, 4-propyl-2-pentenyl, 12-octadecenyl), —S—$R_{6'}$ (wherein $R_{6'}$ represents a substituent group including the same alkyl, aralkyl and alkenyl groups as the foregoing $R_9$ and $R_{10}$ represent, or an optionally substituted aryl group (e.g., phenyl, tolyl, chlorophenyl, bromophenyl, methoxyphenyl, ethoxyphenyl, ethoxycarbonylphenyl)), or —NH$R_{7'}$ (wherein $R_{7'}$ has the same meaning as $R_{6'}$); and further, the combination of $R_9$ and $R_{10}$ may form a ring group such as a 5- or 6-membered single ring group (e.g., cyclopentyl, cyclohexyl), or a 5- or 6-membered ring-containing bicyclo ring (e.g., a bicyloheptane ring, a bicycloheptene ring, a bicyclooctane ring, a bicyclooctene ring), which each may be substituted by a group as cited as examples of the foregoing $R_9$ and $R_{10}$.

q represents an integer of 2 or 3.

In the foregoing formula (III), $R_{11}$ and $R_{12}$ (which may be the same or different) each has the same meaning as the foregoing $R_9$ or $R_{10}$. In addition, $R_{11}$ and $R_{12}$ may combine with each other to complete an aromatic ring (e.g., a benzene ring, a naphthalene ring).

In another preferred embodiment, the resin of this invention contains at least one kind of functional group represented by formula (IV).

$CO—L_2$ (IV)

In the above formula, $L_2$ represents

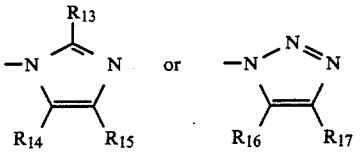

(wherein $R_{13}$, $R_{14}$, $R_{15}$, $R_{16}$ $R_{17}$ each represents a hydrogen atom, or an aliphatic group).

Preferred examples of such an aliphatic group include those represented by the foregoing $R_6$, $R_7$, and $R_8$. In addition, the combination Of $R_{14}$ and $R_{15}$, and that of $R_{16}$ and $R_{17}$, may be an organic group completing a condensed ring, with preferred examples including 5- to 6-membered single rings (e.g., cyclopentene, cyclohexene) and 5- to 12-membered aromatic rings (e.g., benzene, naphthalene, thiophene, pyrrole, pyran, quinoline).

In still another preferred embodiment, the resin of this invention contains at least one kind of oxazolone ring represented by the formula (V).

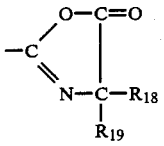

(V)

In the above formula (V), $R_{18}$ and $R_{19}$ may be the same or different, and each represents a hydrogen atom or a hydrocarbon group, or they may combine with each other to form a ring.

Preferably, $R_{18}$ and $R_{19}$ are each a hydrogen atom, an optionally substituted straight- or branched-chain alkyl group containing 1 to 12 carbon atoms (e.g., methyl, ethyl, propyl, butyl, hexyl, 2-chloroethyl, 2-methoxyethyl, 2-methoxycarbonylethyl, 3-hydroxypropyl), an optionally substituted aralkyl group containing 7 to 12 carbon atoms (e.g., benzyl, 4-chlorobenzyl, 4-acetamidobenzyl, phenetyl, 4-methoxybenzyl), an optionally substituted alkenyl group containing 2 to 12 carbon atoms (e.g., ethylene, allyl, isopropenyl, butenyl, hexenyl), an optionally substituted 5- to 7-membered alicyclic ring group (e.g., cyclopentyl, cyclohexyl, chlorocyclohexyl), or an optionally substituted aromatic group (e.g., phenyl, chlorophenyl, methoxyphenyl, acetamidophenyl, methylphenyl, dichlorophenyl, nitrophenyl, naphthyl, butylphenyl, dimethylphenyl), or the combination of $R_{18}$ and $R_{19}$ is a group completing a ring (e.g., tetramethylene, pentamethylene, hexamethylene).

The resins containing at least one kind of functional group selected from among those of the general formulae (I) to (V) can be prepared using a method which involves converting carboxyl groups contained in a polymer to the functional group represented by formula $—COO—L_1$ or $—CO—L_2$ according to the polymer reaction, or a method which involves polymerizing one or more of a monomer containing one or more of a functional group of the general formula $—COO—L_1$ or $—CO—L_2$, or copolymerizing one or more of said monomer and other copolymerizable monomers according to a conventional polymerization reaction.

These preparation methods are described in detail in known literatures cited, e.g., in Nihon Kagakukai (ed.), *Shin-Jikken Kagaku Koza,* vol. 14, "Yuki Kagobutsu no Gosei to Han-no (V)", p. 2535, Maruzen K.K., Yoshio Iwakura and Keisuke Kurita, *Hannosei Kobunshi* (Reactive High Molecules), p. 170, Kodansha, Tokyo.

The method of preparing a polymer from monomers previously containing one or more of the functional group represented by the general formula $—COO—L_1$ or $—CO—L_2$ in accordance with a polymerization reaction is preferred, because the functional group(s) of the formula $—COO—L_1$ or $—CO—L_2$ to be introduced into the polymer can be controlled at one's option, the prepared polymer is not contaminated by impurities, and so on. More specifically, the resins of this invention can be prepared by converting carboxyl group(s) contained in polymerizing double bond-containing carboxylic acids or their halides to the functional group of the formula $—COO—L_1$ or $—CO—L_2$ according to some methods described in known literatures as cited above, and then by carrying out a polymerization reaction.

On the other hand, the resins containing oxazolone rings represented by formula (V) can be prepared by polymerizing one or more of a monomer containing said oxazolone ring, or by copolymerizing the monomer of the above-described kind and other monomers copolymerizable with said monomer.

These oxazolone ring-containing monomers can be prepared from N-acyloyl-α-amino acids containing a polymerizing unsaturated double bond through the dehydrating ring-closure reaction. More specifically, they can be prepared using methods described, e.g., in Yoshio Iwakura & Keisuke Kurita, *Hannosei Kobunshi* (*Reactive High Molecules*), chap. 3, Kodansha.

Specific examples of other monomers capable of copolymerizing with the monomers containing the functional groups of this invention include aliphatic carboxylic acid vinyl or allyl esters, such as vinyl acetate, vinyl propionate, vinyl butyrate, allyl acetate, allyl propionate, etc.; esters or amides of unsaturated carboxylic acids, such as acrylic acid, methacrylic acid, crotonic acid, itaconic acid, maleic acid, fumaric acid, etc.; styrene derivatives, such as styrene, vinyltoluene, α-methylstyrene, etc.; α-olefins; acrylonitrile; methacrylonitrile; and vinyl-substituted heterocyclic compounds, such as N-vinylpyrrolidone, etc.

Specific, but not limiting, examples of the copolymer constituent containing the functional group of the general formulae (I) to (V) to be used, as described above, in the method of preparing a desired resin through the polymerization reaction include those represented by formula (VI).

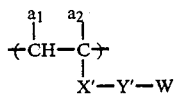

(VI)

wherein X' represents

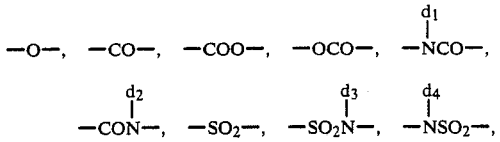

-continued $$-CH_2COO-,\quad -CH_2OCO-,\quad -\underset{b_2}{\overset{b_1}{(C)_l}}-,$$

an aromatic group, or a heterocyclic group (wherein $d_1$, $d_2$, $d_3$ and $d_4$ each represent a hydrogen atom, a hydrocarbon group, or the moiety —Y'—W in the formula (VI); $b_1$ and $b_2$ may be the same or different, each being a hydrogen atom, a hydrocarbon residue or the moiety —Y'—W in the formula (II); and l is an integer of from 0 to 18); Y' represents a carbon-carbon bond or chain for connecting the linkage group X' to the functional group —W, between which hetero atoms (including oxygen, sulfur and nitrogen atom) may be present, which specific examples include

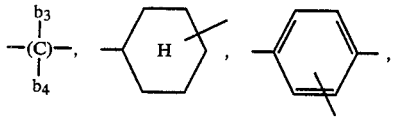

$$\text{-}\!\!\!

-continued
(15)
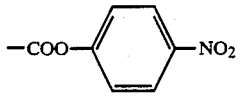
(16)
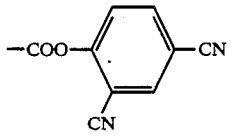
(17)
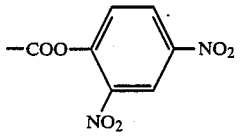
(18)
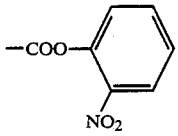
(19)
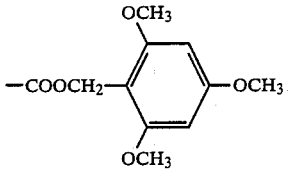
(20)
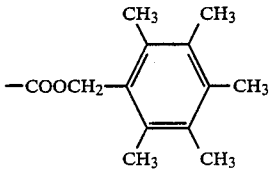
(21)
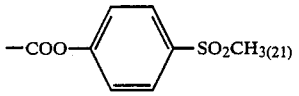
(22)
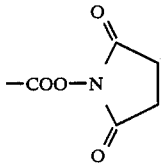
(23)
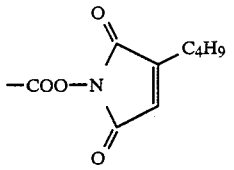
(24)
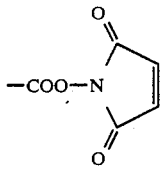
-continued
(25)
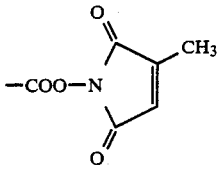
(26)
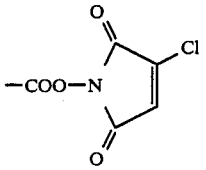
(27)
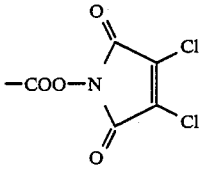
(28)
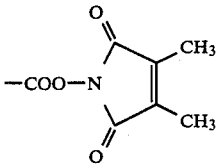
(29)
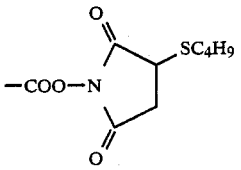
(30)
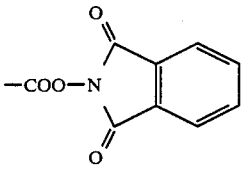
(31)
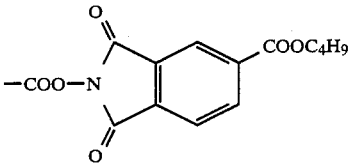
(32)
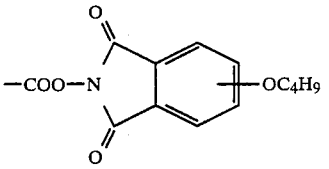
(33)
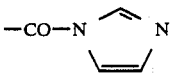
(34)
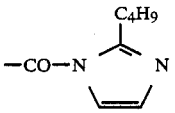

-continued (35)

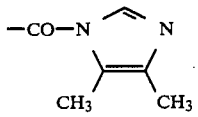

(36)

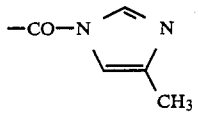

(37)

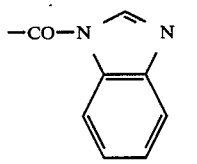

(38)

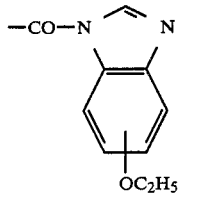

(39)

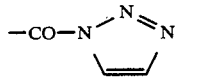

(40)

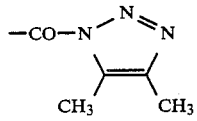

(41)

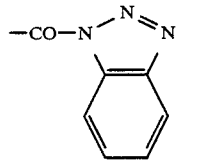

(42)

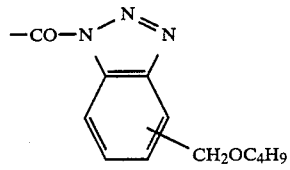

(43)

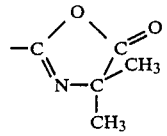

(44)

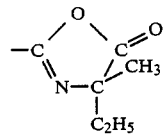

-continued (45)

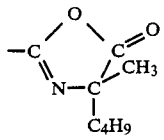

(46)

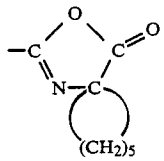

(47)

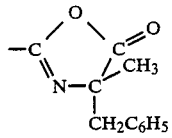

(48) $-COOCH_2OCH_3$ (49)

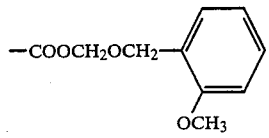

(50) $-COOC(C_6H_5)_3$

(51) $-COOCH(C_6H_5)_2$ (52)

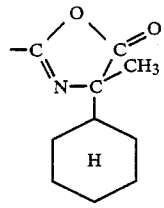

In the resin of the present invention, in particular, consisting of a copolymer, the repeating unit containing carboxyl group-producing functional group is in a proportion of 1 to 95% by weight, preferably 5 to 90% by weight, more preferably 20 to 60% by weight to the resin. Generally, the polymer or copolymer of the resin has a molecular weight of $10^3$ to $10^6$, preferably $5\times10^3$ to $5\times10^5$.

In accordance with a second preferred embodiment of this invention, the resins containing hydroxyl group-producing functional groups are those containing at least one kind of functional group represented by the General Formula (I):

$$-O-L$$

In the general formula (I), L represents $$-\overset{\overset{R_1}{|}}{\underset{\underset{R_3}{|}}{Si}}-R_2,\quad -CO-Y_1,\quad -CO-Z-Y_2,\quad -CH=CH=CH_3,$$

-continued

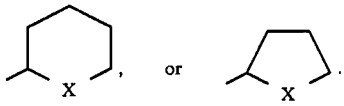

Therein, $R_1$, $R_2$ and $R_3$ may be the same or different, and each represents a hydrogen atom, a hydrocarbon residue, or —O—R′ (R′=a hydrocarbon residue); $Y_1$ and $Y_2$ each represents a hydrocarbon residue; Z represents an oxygen atom, a sulfur atom or —NH— group; and X represents a sulfur atom, or an oxygen atom.

The functional groups of the foregoing general formula —O—L, which produce a hydroxyl group through decomposition, are described in greater detail.

In the case where L represents

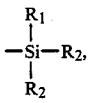

$R_1$, $R_2$ and $R_3$ may be the same or different, each preferably representing a hydrogen atom, an optionally substituted straight or branched chain alkyl group containing 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicyclic group (e.g., cyclopentyl, cyclohexyl), an optionally substituted aralkyl group containing 7 to 12 carbon atoms (e.g., benzyl, phenethyl, fluorobenzyl, chlorobenzyl, methylbenzyl, methoxybenzyl, 3-phenylpropyl), an optionally substituted aromatic group (e.g., phenyl, naphthyl, chlorophenyl, tolyl, methoxyphenyl, methoxycarbonylphenyl, dichlorophenyl), or —O—R′ (wherein R′ represents a hydrocarbon residue, with specific examples including the same ones cited above as examples of $R_1$, $R_2$ and $R_3$).

In the case where L represents —CO—$Y_1$, $Y_1$ preferably represents an optionally substituted straight or branched chain alkyl group containing 1 to 6 carbon atoms (e.g., methyl, trichloromethyl, trifluoromethyl, methoxymethyl, phenoxymethyl, 2,2,2-trifluoroethyl, t-butyl, hexafluoro-i-propyl), an optionally substituted aralkyl group containing 7 to 9 carbon atoms (e.g., benzyl, phenethyl, methylbenzyl, trimethylbenzyl, heptamethylbenzyl, methoxybenzyl), or an optionally substituted aryl group containing 6 to 12 carbon atoms (e.g., phenyl, nitrophenyl, cyanophenyl, methane sulfonylphenyl; methoxyphenyl, butoxyphenyl, chlorophenyl, dichlorophenyl, trifluoromethylphenyl).

In the case where L represents —CO—Z—$Y_2$, Z is an oxygen atom, a sulfur atom, or a —NH— linkage group; and $Y_2$ has the same meaning as the foregoing $Y_1$.

In the case where L represents

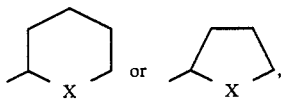

X represents an oxygen atom or a sulfur atom.

The resins containing at least one kind of functional group selected from those of the general formula —O—L can be prepared using a method which involves converting hydroxyl groups contained in a polymer to the functional group represented by the general formula —O—L according to the high-molecular reaction, or a method which involves polymerizing one or more of a monomer containing one or more of a functional group of the general formula —O—L, or copolymerizing one or more of said monomer and other copolymerizable monomers according to a conventional polymerization reaction.

The high-molecular reaction is disclosed in Yoshio Iwakura and Keisuke Kurita, *Hannosei Kobunshi* (*Reactive High Molecules*), p. 158, Kodansha, Tokyo, and methods of converting a hydroxyl group contained in a monome to the functional group represented by the general formula —O—L are described in detail, e.g., in Nihon Kagakukai (ed.), *Shin-Jikken Kagaku Koza,* vol. 14, "Yuki Kagobutsu no Gosei to Han-no (V)", p. 2497, Maruzen K.K.

The method of preparing a polymer from monomers previously containing functional groups of the general formula —O—L in accordance with a polymerization reaction is preferred, because functional groups to be introduced into the polymer can be readily controlled such that the prepared polymer is not contaminated with impurities, etc. These monomers can be prepared by converting at least one hydroxyl group contained in a compound having a polymerizing double bond into the functional group of the general formula —O—L according to method as described above, or by reacting a compound containing the functional group of the general formula —O—L with a compound having a polymerizing double bond.

The monomers containing the functional groups of the general formula —O—L to be used, as described above, in preparing a desired resin by a polymerization reaction include, for example, compounds represented by the following general formula (II).

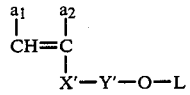

(II)

wherein X′ represents

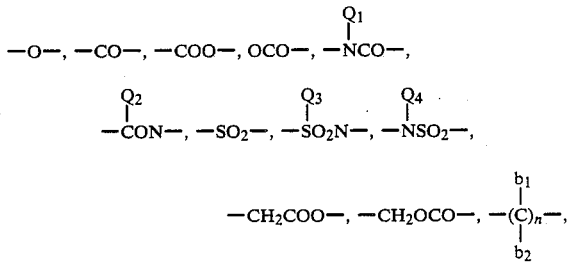

an aromatic group, or a heterocyclic group (wherein $Q_1$, $Q_2$, $Q_3$ and $Q_4$ each represent a hydrogen atom, a hydrocarbon residue, or the moiety —Y′—O—L in formula (II); $b_1$ and $b_2$ may be the same or different, each being a hydrogen atom, a hydrocarbon residue or the moiety —Y′—O—L in formula (II); and n is an integer of from 0 to 18); Y′ represents carbon-carbon bond(s) for connecting the linkage group X′ to the functional group —O—L, between which hetero atoms (e.g., oxygen, sulfur, nitrogen) may be present, specific examples including, individually or in combination,

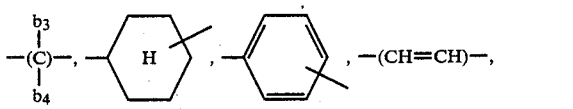

—O—, —S—, —N(b5)—, —COO—, —CONH, —$SO_2$—,

—$SO_2NH$—, —NHCOO— or/and —NHCONH—

(wherein $b_3$, $b_4$ and $b_5$ each have the same meaning as the foregoing $b_1$ or $b_2$); L has the same meaning as in the formula (I); and $a_1$ and $a_2$ may be the same or different, each being a hydrogen atom, a hydrocarbon residue (e.g., an alkyl group containing 1 to 12 carbon atoms, which may be substituted with —COOH or so on), —COOH or —COO—W (wherein W represents an alkyl group containing 1 to 18 carbon atoms, an alkenyl group, an aralkyl group, an alicyclic group or an aromatic group, each of which may be substituted with a group including the functional group of the formula —O—L).

Specific but non-limiting examples of monomers containing the functional group of the general formula —O—L are illustrated below, wherein Me represents a methyl group.

(1)

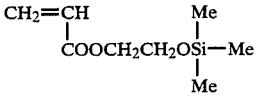

(2)

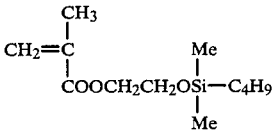

(3)

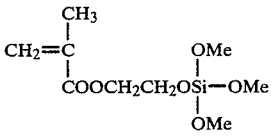

(4)

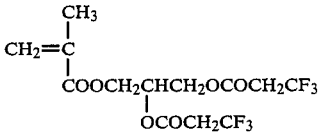

(5)

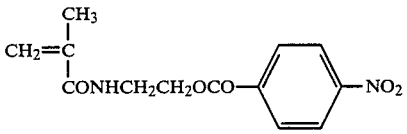

(6)

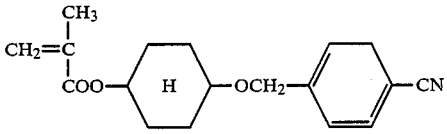

(7)

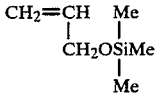

-continued (8)

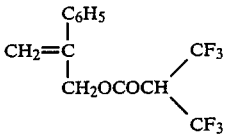

(9)

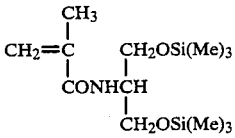

(10)

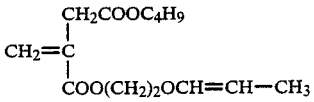

(11)

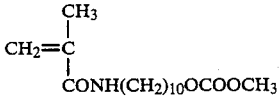

(12)

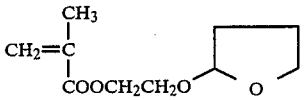

(13)

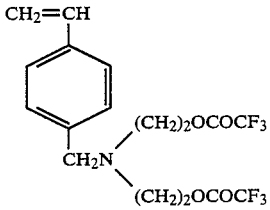

(14)

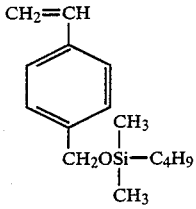

(15)

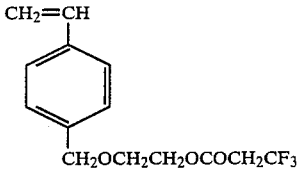

(16)

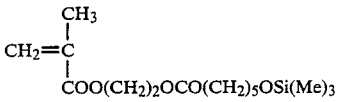

(17)

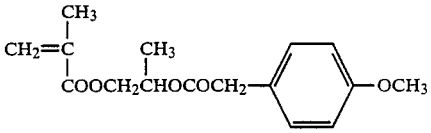

(18)

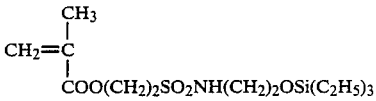

-continued (19)

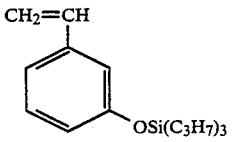

(20)

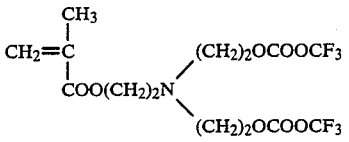

(21)

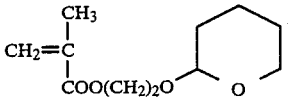

(22)

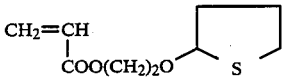

(23)

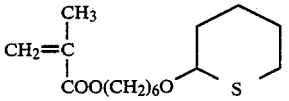

(24)

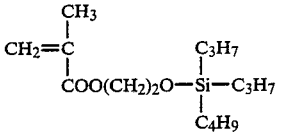

These monomers may be either homopolymerized or copolymerized with other copolymerizable monomers. Suitable examples of other copolymerizing monomers include vinyl or allyl esters of aliphatic carboxylic acids, such as vinyl acetate, vinyl propionate, vinyl butyrate, allyl acetate, allyl propionate, etc.; esters or amides of unsaturated carboxylic acids such as acrylic acid, methacrylic acid, crotonic acid, itaconic acid, maleic acid, fumaric acid, etc.; styrene derivatives such as styrene, vinyl toluene, α-methylstyrene, etc.; α-olefins; acrylonitrile; methacrylonitrile; and vinyl-substituted heterocyclic compounds such as N-vinylpyrrolidone, etc.

In this embodiment, preferably, the resins containing hydroxyl group-producing functional groups are those containing at least one kind of functional group which has at least two hydroxyl groups located in a position sterically next to each other in such a form as to both be protected by a single protecting group. Specific examples of such functional groups are those represented by the following general formulae (III), (IV), (V) and (VI):

(III)

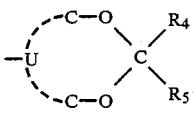

(wherein $R_4$ and $R_5$ may be the same or different, each being a hydrogen atom, a hydrocarbon residue, or —O—O—R″ (wherein R″ represents a hydrocarbon residue); and U represents a carbon-carbon chain in which a hetero atom may be introduced (provided that the number of atoms present between the two oxygen atoms does not exceed 5))

(IV)

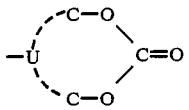

(wherein U has the same meaning as in (III))

(V)

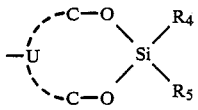

(wherein $R_4$, $R_5$ and U have the same meanings as in (III), respectively).

(VI)

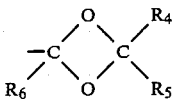

(wherein $R_4$ and $R_5$ have the same meanings as in (III) respectively and $R_6$ represents a hydrogen atom or an aliphatic group containing 1 to 8 carbon atoms (e.g., alkyl groups such as methyl, ethyl, propyl, butyl, etc., or aralkyl groups such as benzyl, phenethyl, methylbenzyl, methoxybenzyl, chlorobenzyl, etc.).)

These functional groups are more specifically described below.

In the formula (III), $R_4$ and $R_5$ may be the same or different, and each preferably represents a hydrogen atom, an alkyl group containing 1 to 12 carbon atoms, which may be substituted (e.g., methyl, ethyl, propyl, butyl, hexyl, 2-methoxyethyl, octyl), an aralkyl group containing 7 to 9 carbon atoms, which may be substituted (e.g., benzyl, phenethyl, methylbenzyl, methoxybenzyl, chlorobenzyl), an alicyclic residue containing 5 to 7 carbon atoms (e.g., cyclopentyl, cyclohexyl), an aryl group, which may be substituted (e.g., phenyl, chlorophenyl, methoxyphenyl, methylphenyl, cyanophenyl), or —O—R‴ (wherein R‴ represents the same hydrocarbon residue as $R_4$ and $R_5$).

U represents a carbon-carbon chain in which hetero atoms may be introduced, provided that the number of atoms present between the two oxygen atoms does not exceeding 5.

Resins containing functional groups of at least one kind for use in the present invention are prepared in accordance with a method which involves utilizing a high-molecular reaction. As such, the hydroxyl groups in a polymer which are located in a position sterically next to each other are transformed in such a manner that they are protected by a protecting group. Methods which involve polymerizing a monomer which contains prior to polymerization at least two hydroxyl groups protected by a protecting group, or copolymerizing said monomer and other copolymerizing monomers in accordance with a polymerization reaction may also be used in the present invention.

In the former preparation method which utilizes a high-molecular reaction, polymers having a repeating unit as illustrated below, which have at least two hydroxyl groups adjacent to each other or one hydroxyl group in such a position as to be near a hydroxyl group in another unit as the result of polymerization, for example,

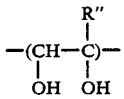
(i)

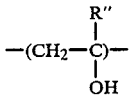
(ii)

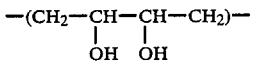
(iii)

(wherein R″ represents H, or a substituent such as $CH_3$)

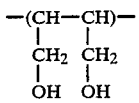
(iv)

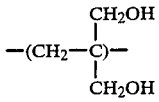
(v)

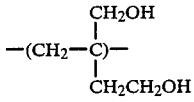
(vi)

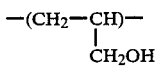
(vii)

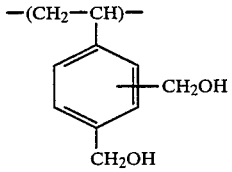
(viii)

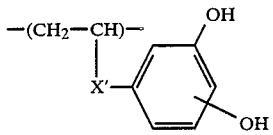
(ix)

(X′ = linkage group)

or the like, are allowed to react with a carbonyl compound, an ortho ester compound, a halogen-substituted formic acid ester, a dihalogenated silyl compounds, or the like to result in formation of the intended functional groups having at least two hydroxyl groups protected by the same protecting group.

More specifically, such polymers can be prepared in accordance with known methods described in, e.g., Nihon Kagakukai (ed.), *Shin-Jikken Kagaku Koza*, vol. 14, "Yuki Kagobutsu no Gosei to Han-no (V)", p. 2505, Maruzene K. K., and J. F. W. McOmie, *Protective Groups in Organic Chemistry,* chaps. 3 to 4, Plenum Press.

In the latter method, monomers initially having at least two protected hydroxyl groups are first prepared in accordance by methods cited in the aforementioned publications, and then polymerized, if desired, in the presence of other copolymerizing monomers in a conventional polymerization process to obtain a homopolymer or a copolymer.

Specific but non-limiting examples of the repeating units having the foregoing kind of functional groups to be present in the polymers of this invention are shown as follows:

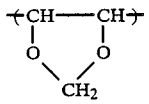
(25)

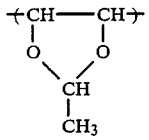
(26)

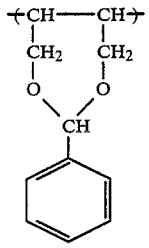
(27)

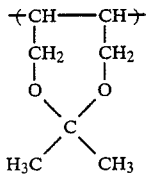
(28)

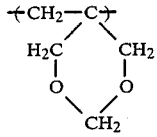
(29)

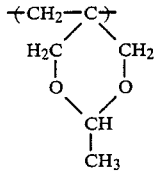
(30)

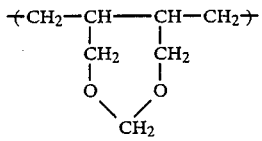
(31)

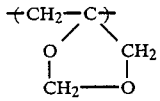
(32)

-continued
(33)
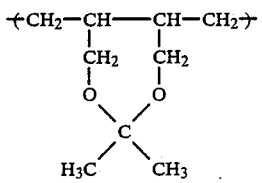
(34)
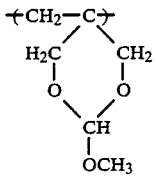
(35)
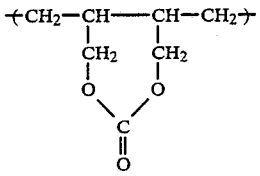
(36)
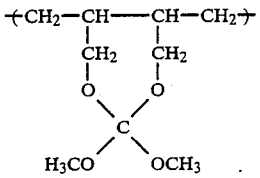
(37)
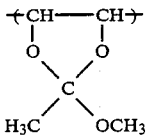
(38)
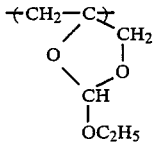
(39)
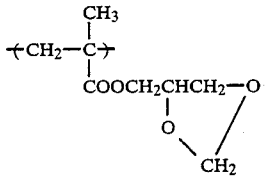
(40)
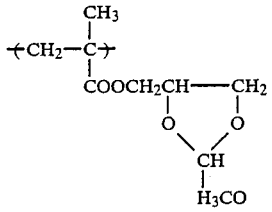
-continued
(41)
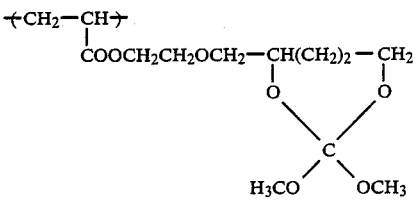
(42)
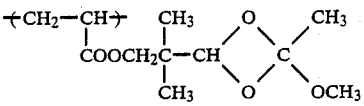
(43)
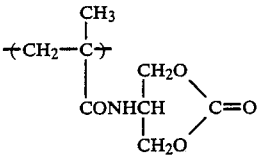
(44)
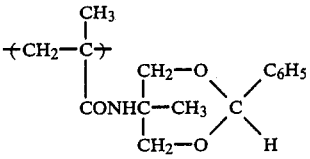
(45)
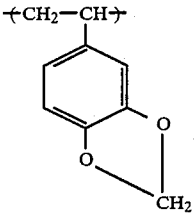
(46)
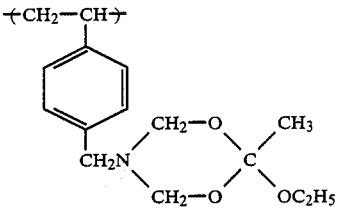
(47)
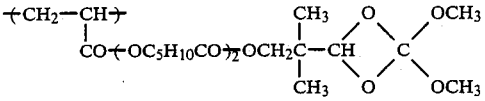
(48)
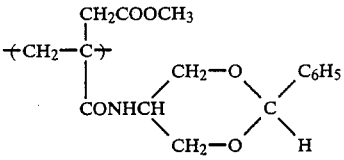
(49)
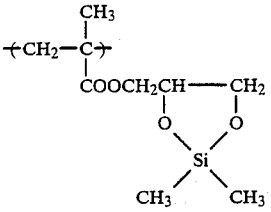

-continued (50)

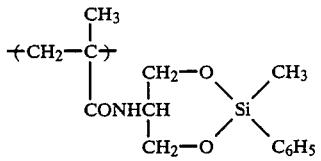

In the resin of the present invention, in particular, consisting of a copolymer, the repeating unit containing hydroxyl group-producing functional group is in a proportion of 1 to 95% by weight, preferably 5 to 60% by weight to the resin. Generally, the polymer or copolymer of the resin has a molecular weight of $10^3$ to $10^6$, preferably $5\times10^3$ to $5\times10^5$.

When the resin of the present invention consists of a copolymer, as monomers to be copolymerized with a monomer containing the above described hydroxyl group-producing functional group, there can be used α-olefins, vinyl or allyl esters of alkanic acids, acrylonitrile, methacrylonitrile, vinyl ethers, acrylamides, methacrylamides, styrenes and heterocyclic vinyl compounds such as vinylpyrrolidone, vinylpyridine, vinylimidazole, vinylthiophene, vinylimidazoline, vinylpyrazole, vinyldioxane, vinylquinoline, vinylthiazole, vinyloxazine and the like. Above all, vinyl acetate, allyl acetate, acrylonitrile, methacrylonitrile and styrenes are preferably used from the standpoint of increasing the film strength.

In accordance with a third preferred embodiment of the present invention, the resins containing thiol group-producing functional groups are those containing at least one kind of functional groups represented by general formula (I):

$$(-S-L^A) \qquad (I)$$

wherein $L^A$ represents

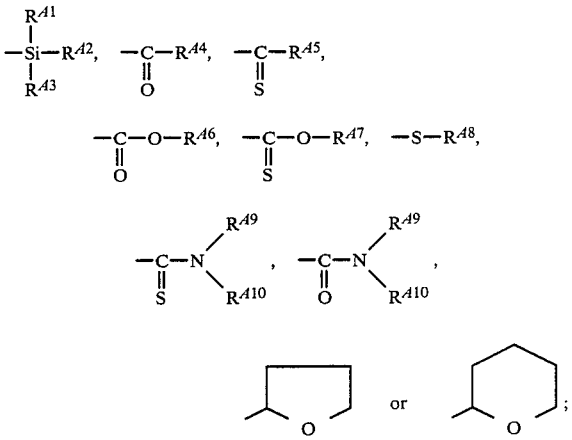

wherein $R^{A1}$, $R^{A2}$, and $R^{A3}$, which may be the same or different, each represents a hydrocarbon group or —O—$R^{A'}$ (wherein $R^{A''}$ represents a hydrocarbon group); and $R^{A4}$, $R^{A5}$, $R^{A6}$, $R^{A7}$, $R^{A8}$, $R^{A9}$, and $R^{A10}$ independently each represents a hydrocarbon group.

The functional group of the formula (—S—$L^A$) forms a thiol group by decomposition, which is explained in detail hereinafter.

When $L^A$ represents

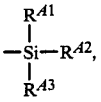

$R^{A1}$, $R^{A2}$ and $R^{A3}$ may be the same or different and each preferably represents a hydrogen atom, an optionally substituted linear or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicyclic group having from 5 to 8 carbon atoms (e.g., cyclopentyl, cyclohexyl), an optionally substituted aralkyl group having from 7 to 12 carbon atoms (e.g., benzyl, phenethyl, chlorobenzyl, methoxybenzyl), an optionally substituted aromatic group having from 6 to 12 carbon atoms (e.g., phenyl, naphthyl, chlorophenyl, tolyl, methoxyphenyl, methoxycarbonylphenyl, dichlorophenyl) or —O—$R^{A'}$ (in which $R^{A'}$ represents a hydrocarbon group and, for example, has the same meaning as the hydrocarbon group described for $R^{A1}$, $R^{A2}$ and $R^{A3}$).

When $L^A$ represents

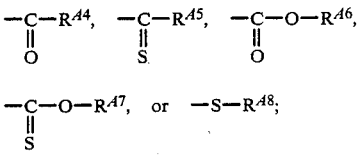

$R^{A4}$, $R^{A5}$, $R^{A6}$, $R^{A7}$ and $R^{A8}$ each preferably represents an optionally substituted linear or branched alkyl group having from 1 to 12 carbon atoms (e.g., methyl, trichloromethyl, trifluoromethyl, methoxymethyl, ethyl, propyl, n-butyl, hexyl, 3-chloropropyl, phenoxymethyl, 2,2,2-trifluoroethyl, t-butyl, hexafluoro-i-propyl, octyl, decyl), an optionally substituted aralkyl group having from 7 to 12 carbon atoms (e.g., benzyl, phenethyl, methylbenzyl, trimethylbenzyl, pentamethylbenzyl, methoxybenzyl), or an optionally substituted aryl group having from 6 to 12 carbon atoms (e.g., phenyl, nitrophenyl, cyanophenyl, methanesulfonylphenyl, methoxyphenyl, butoxyphenyl, chlorophenyl, dichlorophenyl, trifluoromethylphenyl).

When $L^A$ represents

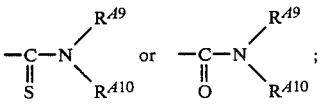

$R^{A9}$ and $R^{A10}$ may be the same or different, and preferred examples of the groups may be selected from the substituents described for $R^{A4}$ to $R^{A8}$.

Other preferred thiol group-producing functional group-containing resins for use in the present invention are resins having at least one thiirane ring, as represented by the following general formula (II) or (III):

(II)

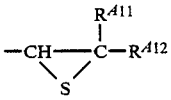

-continued (III)

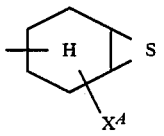

In the formula (II), $R^{A11}$ and $R^{A12}$ may be the same or different and each represents a hydrogen atom or a hydrocarbon group. Preferred examples of the groups may be selected from the substituents preferred for $R^{A4}$ to $R^{A7}$.

In the formula (III), $X^A$ represents a hydrogen atom or an aliphatic group. The aliphatic group preferably includes an alkyl group having from 1 to 6 carbon atoms (e.g., methyl, ethyl, propyl, butyl).

Still other preferred thiol group-producing functional group-containing resins for use in the present invention are resins containing at least one sulfur atom-containing heterocyclic group, as represented by the following general formula (IV).

(IV)

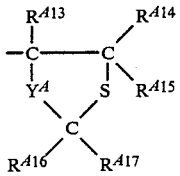

In the formula (IV), $Y^A$ represents an oxygen atom or —NH—.

$R^{A13}$, $R^{A14}$ and $R^{A15}$ may be the same or different and each represents a hydrogen atom or a hydrocarbon group. Preferably, these each represent a hydrogen atom or the group preferred for $R^{A4}$ to $R^{A7}$.

$R^{A16}$ and $R^{A17}$ may be the same or different and each represents a hydrogen atom, a hydrocarbon group or —O—$R^{A''}$ (in which $R^{A''}$ represents a hydrocarbon group). Preferably, these each represents the group preferred for $R^{A1}$ to $R^{A3}$.

In accordance with this embodiment of the present invention, more preferably the thiol group-producing functional group-containing resins for use in the present invention are resins having at least one functional group composed of at least two thiol groups which are stereostructurally adjacent each other and are protected by one protective group.

Examples of functional groups composed of at least two thiol groups which are stereostructurally adjacent each other and are protected by one protective group, are the following groups of formulae (V), (VI) and (VII)

(V)

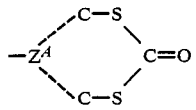

(VI)

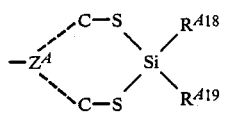

-continued (VII)

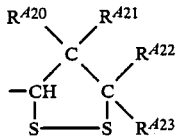

In the formulae (V) and (VI), $Z^A$ represents an optionally hetero atom-interrupted carbon-carbon linkage or represents a chemical bond directly bonding the two C—S bonds in the formulae, provided that the number of the atoms between the sulfur atoms is 4 or less. Further, one of the —($Z^A$ . . . C)— bonds may represent a mere bond only, for example, as follows.

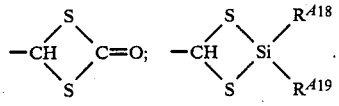

In the formula (VI), $R^{A18}$ and $R^{A19}$ may be the same or different and each represents a hydrogen atom, a hydrocarbon group or —O—$R^{A''}$ (in which $R^{A''}$ represents a hydrocarbon group).

Preferably, $R^{A18}$ and $R^{A19}$ may be the same or different and each represents a hydrogen atom, an optionally substituted alkyl group having from 1 to 12 carbon atoms (e.g., methyl, ethyl, propyl, butyl, hexyl, 2-methoxyethyl, octyl), an optionally substituted aralkyl group having from 7 to 12 carbon atoms (e.g., benzyl phenetyl, methylbenzyl, methoxybenzyl, chlorobenzyl), an alicyclic group having from 5 to 8 carbon atoms (e.g., cyclopentyl, cyclohexyl), an optionally substituted aryl group having from 6 to 12 carbon atoms (e.g., phenyl, chlorophenyl, methoxyphenyl, methylphenyl, cyanophenyl) or —O—$R^{A''}$ (in which $R^{A''}$ represents a hydrocarbon group which may be the same as the group for $R^{A18}$ and $R^{A19}$).

In the formula (VII), $R^{A20}$, $R^{A21}$, $R^{A22}$ and $R^{A23}$ may be the same or different and each represents a hydrogen atom or a hydrocarbon group. Preferably, each represents a hydrogen atom or a hydrocarbon group which may be the same as the group preferred for $R^{A18}$ and $R^{A19}$.

The resins containing at least one functional group represented by any of the formulae (I) to (VII) for use in the present invention can be prepared by protecting the thiol group(s) in a thiol group-containing polymer with a protective group by polymer reaction or by polymerizing a monomer having one or more protected thiol groups or copolymerizing the monomer with other copolymerizable monomer(s).

It is difficult to directly polymerize a thiol group-containing monomer, since the thiol group of the monomer interferes with radical polymerization. Accordingly, the thiol group may be introduced into a thiol group-free polymer by polymer reaction; or alternatively, the thiol group in the monomer to be polymerized is previously protected to a protected functional group, for example, in the form of a isothiuronium salt or Bunte salt, the thus protected monomer is polymerized and then the resulting polymer is subjected to a decomposition reaction to decompose the protected thio group into a free thiol group.

The method of producing the thiol group-containing polymers for use in the present invention, in which a monomer containing one or more functional groups of any of the formulae (I) to (VII) is polymerized or copolymerized, is therefore preferred, because polymers having one or more functional groups of protected thiol groups may freely be prepared, no impurities are introduced into the polymers formed and monomers having free (or unprotected) thiol group(s) are hardly polymerized.

For conversion of one or at least two thiol groups into one or more protected functional groups, for example, the methods described in the literature in Iwakura and K. Kurita, *Hanno-sei Kobunshi* (*Reactive Polymers*), pages 230 to 237 (published by Kodan-sha, 1977); *Shinjikken Kaqaku Koza* (*New Lecture of Experimental Chemistry*), Vol. 14, Synthesis and Reaction of Organic Compounds (III), Chap. 8, pages 1700 to 1713 (edited by Nippon Kagaku-kai and published by Maruzen, 1978); J. F. W. McOmie, *Protective Groups in Orqanic Chemistry*, Chap. 7 (published by Plenum Press, 1973); or S. Patai, *The Chemistry of the Thiol Group*, Part 2, Vol. 12, Chap. 14 (published by John Wiley & Sons, 1974) may be employed.

Monomers having one or more protected thiol groups, for example, those having one or more functional groups of the formulae (I) to (VII), can be prepared by converting the thiol group(s) in compounds having a polymerizable double bond and having at least one thiol group into the functional group(s) of the formulae (I) to (VII), for example, in accordance with the methods described in the literature above or by reacting a compound containing one or more functional groups of the formulae (I) to (VII) and a compound having a polymerizable double bond.

Specific examples of repeating units having one or more functional groups of the formulae (I) to (VII) are the following compounds, which, however, are not to be construed whatsoever as limitative.

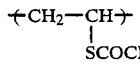
(1)

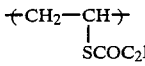
(2)

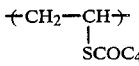
(3)

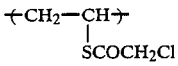
(4)

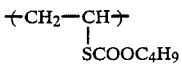
(5)

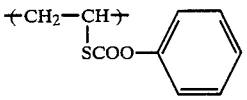
(6)

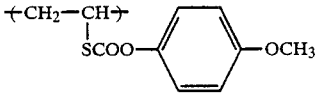
(7)

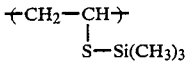
(8)

-continued

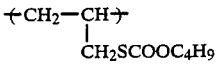
(9)

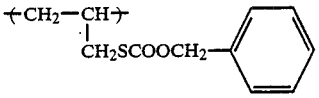
(10)

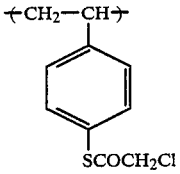
(11)

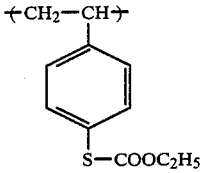
(12)

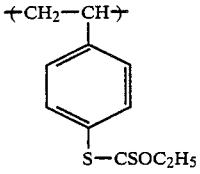
(13)

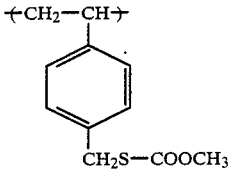
(14)

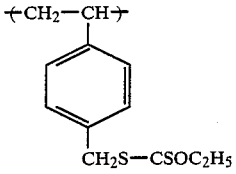
(15)

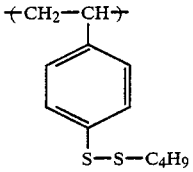
(16)

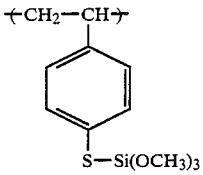
(17)

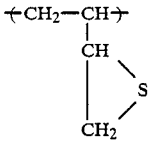
(18)

-continued
(19)
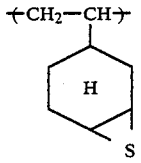
(20)
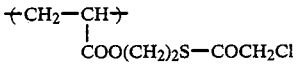
(21)
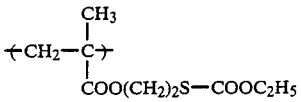
(22)
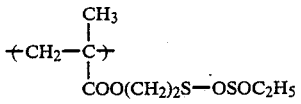
(23)
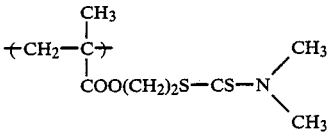
(24)
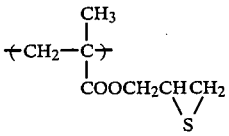
(25)
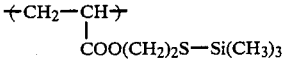
(26)
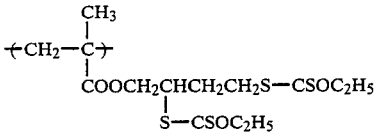
(27)
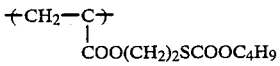
(28)
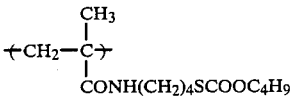
(29)
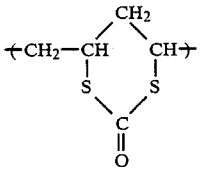
(30)
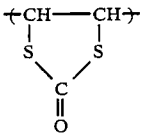
-continued
(31)
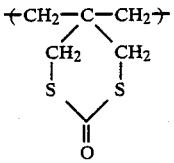
(32)
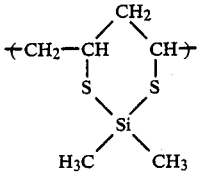
(33)
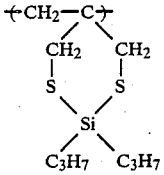
(34)
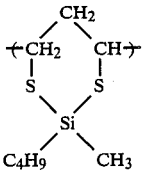
(35)
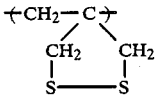
(36)
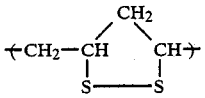
(37)
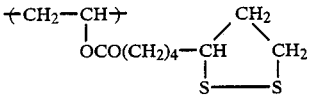
(38)
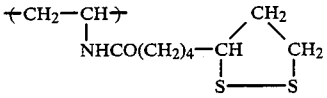
(39)
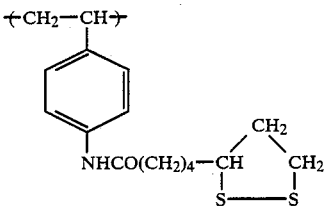
(40)
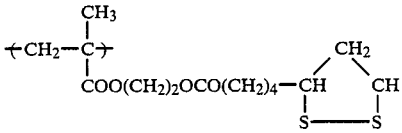
(41)
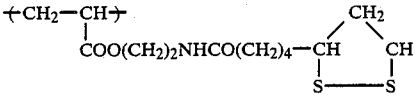

-continued (42)

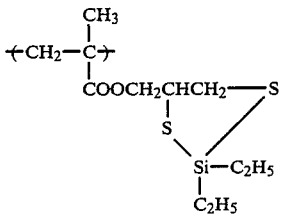

(43)

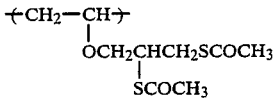

(44)

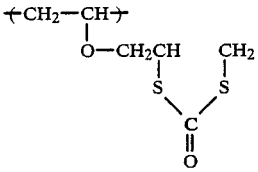

(45)

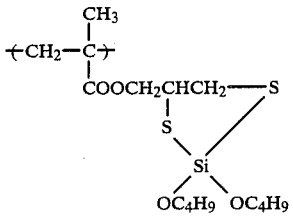

(46)

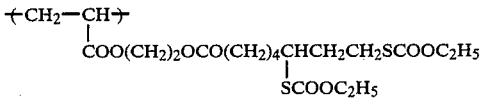

(47)

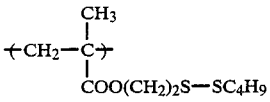

(48)

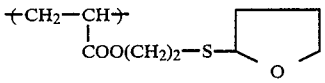

(49)

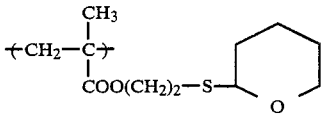

(50)

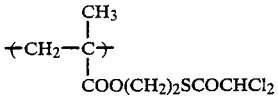

(51)

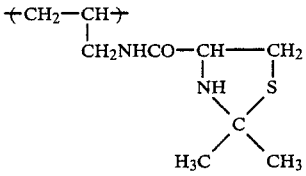

-continued (52)

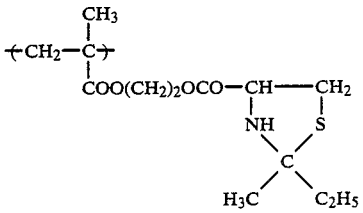

(53)

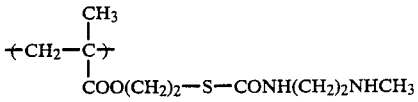

Resins containing functional group(s) capable of forming phosphono group, such as those of the following formula (VIII) or (IX), by decomposition, which can be used in the present invention, are explained hereunder.

(VIII)

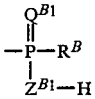

(IX)

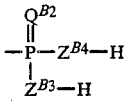

In the formulae (VIII), $R^B$ represents a hydrocarbon group or $—Z^{B2}—R^{B'}$ (in which $R^{B'}$ represents a hydrocarbon group, and $Z^{B2}$ represents an oxygen atom or a sulfur atom). $Q^{B1}$ represents an oxygen atom or a sulfur atom. $Z^{B1}$ represents an oxygen atom or a sulfur atom. In the formula (IX), $Q^{B2}$, $Z^{B3}$, and $Z^{B4}$ independently represent an oxygen atom or a sulfur atom.

Preferably, Rs represents an optionally substituted linear or branched alkyl group having from 1 to 12 carbon atoms (e.g., methyl, ethyl, propyl, butyl, pentyl, hexyl, octyl, decyl, 2-methoxyethyl, 3-methoxypropyl, 2-ethoxyethyl), an optionally substituted alicyclic group having from 5 to 8 carbon atoms (e.g., cyclopentyl cyclohexyl), an optionally substituted aralkyl group having from 7 to 12 carbon atoms (e.g., benzyl, phenethyl, methylbenzyl, methoxybenzyl, chlorobenzyl), an optionally substituted aromatic group having from 6 to 12 carbon atoms (e.g., phenyl, chlorophenyl, tolyl, xylyl, methoxyphenyl, methoxycarbonylphenyl, dichlorophenyl) or $—Z^{B2}—R^{B'}$ (where $Z^{B2}$ represents an oxygen atom or a sulfur atom, and $R^{B'}$ represents a hydrocarbon group, examples of which include the hydrocarbon groups mentioned for $R^B$).

$Q^{B1}$, $Q^{B2}$, $Z^{B3}$ and $Z^{B4}$ independently represent an oxygen atom or a sulfur atom.

Examples of the functional groups capable of forming the phosphono group represented by the formula (VIII) or (IX) by decomposition are those represented by the following formulae (X) and/or (XI).

(X)

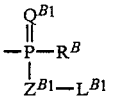

-continued

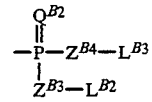

(XI)

In the formulae (X) and (XI), $Q^{B1}$, $Q^{B2}$, $Z^{B1}$, $Z^{B3}$ $Z^{B4}$ and $R^B$ have the same meanings as those defined for the formulae (VIII) and (IX).

$L^{B1}$, $L^{B2}$ and $L^{B3}$ independently represent

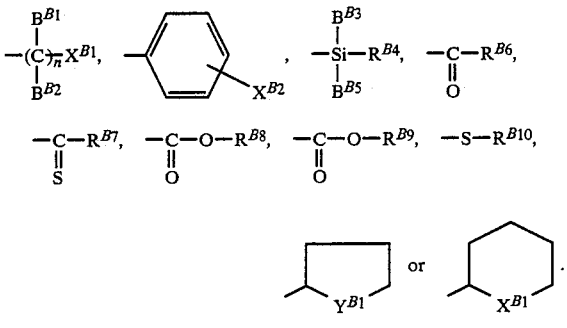

When $L^{B1}$ to $L^{B3}$ each represents

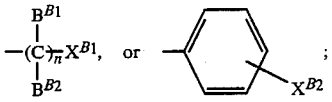

$R^{B1}$ and $R^{B2}$ may be the same or different and each represents a hydrogen atom, a halogen atom (e.g., chlorine, bromine, fluorine) or a methyl group. $X^{B1}$ and $X^{B2}$ each represents an electron-attracting substituent (which means a substituent whose Hammett's substituent constant is positive, such as halogen atoms, —COO—,

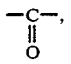

—$SO_2$—, —CN, —$NO_2$, etc.), preferably a halogen atom (e.g., chlorine, bromine, fluorine), —CN, —$CONH_2$, —$NO_2$ or —$SO_2R^{B''}$ (in which $R^{B''}$ represents a hydrocarbon group such as methyl, ethyl, propyl, butyl, hexyl, benzyl, phenyl, tolyl, xylyl or mesityl). n represents 1 or 2. When $X^{B1}$ is methyl group, $R^{B1}$ and $R^{B2}$ both are methyl groups and n is 1.

When $L^{B1}$ to $L^{B2}$ each represents

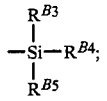

$R^{B3}$, $R^{B4}$ and $R^{B5}$ may be the same or different and each preferably represents a hydrogen atom, an optionally substituted linear or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicyclic group having from 5 to 8 carbon atoms (e.g., cyclopentyl cyclohexyl), an optionally substituted aralkyl group having from 7 to 12 carbon atoms (e.g., benzyl, phenethyl, chlorobenzyl, methoxybenzyl), an optionally substituted aromatic group having from 6 to 12 carbon atoms (e.g., phenyl, naphthyl, chlorophenyl, tolyl, methoxyphenyl, methoxycarbonylphenyl, dichlorophenyl) or —O—$R^{B'''}$ (in which $R^{B'''}$ represents a hydrocarbon group, examples of which include the hydrocarbon groups described for $R^{B3}$, $R^{B4}$ and $R^{B5}$).

When $L^{B1}$ to $L^{B2}$ each represents

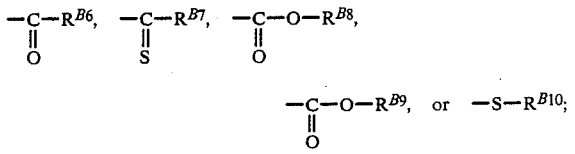

$R^{B6}$, $R^{B7}$, $R^{B8}$, $R^{B9}$ and $R^{B10}$ independently represent a hydrocarbon group, preferably an optionally substituted linear or branched alkyl group having from 1 to 6 carbon atoms (e.g., methyl, trichloromethyl, trifluoromethyl, methoxymethyl, phenoxymethyl, 2,2,2-trifluoroethyl, ethyl, propyl, hexyl, t-butyl, hexafluoro 1-propyl), an optionally substituted aralkyl group having from 7 to 12 carbon atoms (e.g., benzyl, phenethyl, methylbenzyl, trimethylbenzyl, pentamethylbenzyl, methoxybenzyl or an optionally substituted aryl group having from 6 to 12 carbon atoms (e.g., phenyl, tolyl, xylyl, nitrophenyl, cyanophenyl, methanesulfonylphenyl, methoxyphenyl, butoxyphenyl, chlorophenyl, dichlorophenyl, trifluoromethylphenyl).

When $L^{B1}$ to $L^{B2}$ each represents

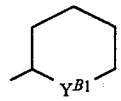

or

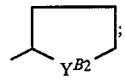

$Y^{B1}$ and $Y^{B2}$ each represents an oxygen atom or a sulfur atom.

The resins having at least one functional group for use in the present invention can be prepared by a method of protecting the hydrophilic group (phosphono group) of the aforesaid formula (VIII) or (IX) in a polymer by a protective group by polymer reaction, or by a method of polymerizing a monomer having a previously protected functional group (for example, the functional group of formula (X) or (XI)) or copolymerizing the monomer with a copolymerizable monomer.

In any of these methods, the same synthesizing reaction may be employed to introduce the protective group. Briefly, the resins for use in the present invention can be prepared by the method described in the literature as referred to in J. F. W. McOmie, *Protective Groups in Organic Chemistry,* Chap. 6 (published by Plenum Press, 1973), or in accordance with the same synthesizing reaction as the method of introducing a protective group into the hydroxyl group in a polymer described in literature of *Shin-Jikken Kagaku Koza* (New Lecture of Experimental Chemistry), Vol. 14, Synthesis and Reaction of Organic Compounds (V), page 2497 (published by Maruzen, 1978) or also in accordance with the same synthesizing reaction as the method of introducing a protective group into the thiol group in a polymer described in literature of S. Patai, *The Chemistry of the Thiol Group, Psart* 2, Vol. 13, Chap. 14 (published by Wiley-Interscience, 1974) or T. W. Greene, *Protective Groups in Organic Synthesis,* Chap. 6 (published by Wiley-Interscience, 1981).

Examples of compounds suitable as repeating units of the polymer components containing the functional groups of the formulae (X) and/or (XI) as protective groups are shown below, which, however, are not intended to restrict the scope of the present invention.

(54)

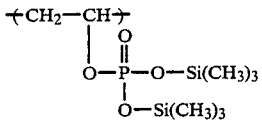

(55)

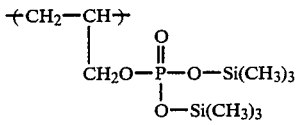

(56)

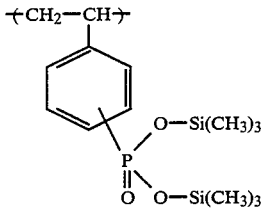

(57)

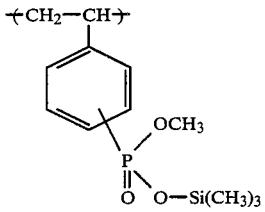

(58)

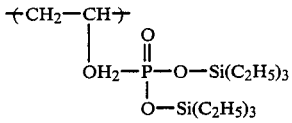

(59)

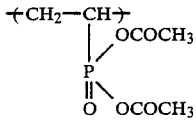

(60)

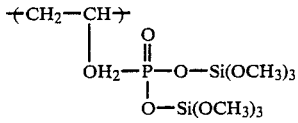

(61)

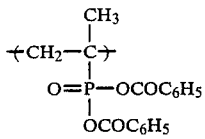

-continued (62)

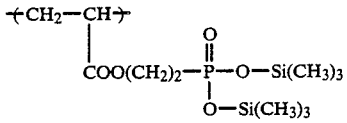

(63)

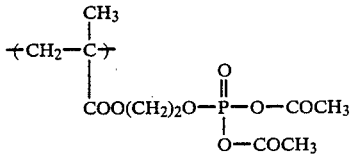

(64)

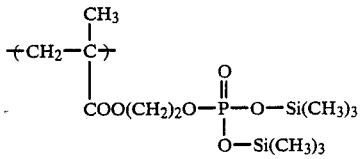

(65)

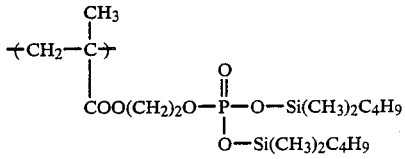

(66)

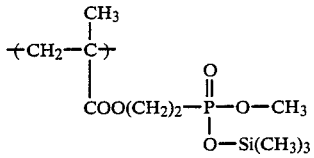

(67)

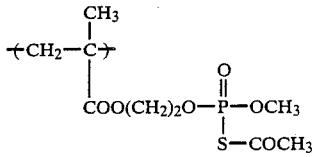

(68)

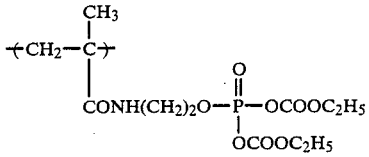

(69)

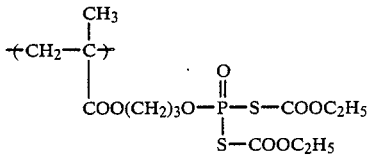

(70)

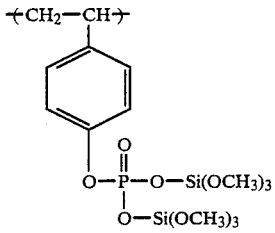

-continued (71)

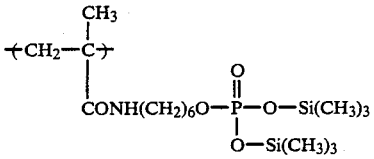

(72)

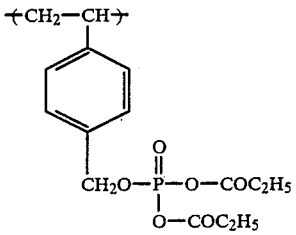

(73)

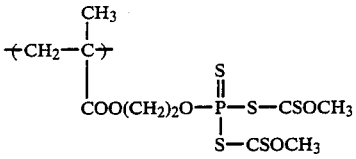

(74)

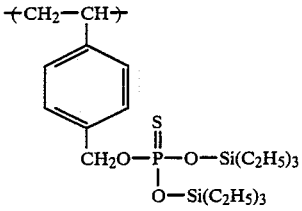

(75)

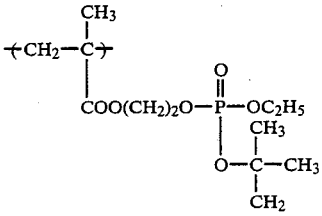

(76)

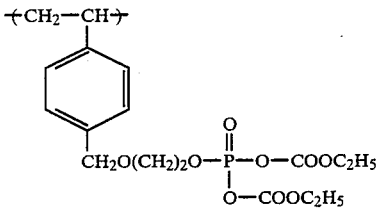

(77)

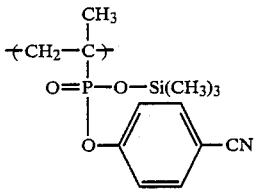

(78)

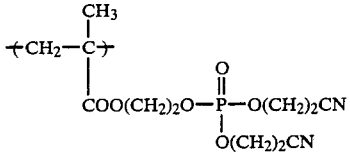

Functional groups capable of forming amino group(s), such as $—NH_2$ group and/or $—NHR^{CO}$ group, for example, are groups as represented by any of the following general formulae (XII) to (XIV).

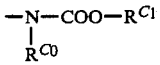

(XII)

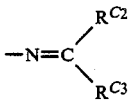

(XIII)

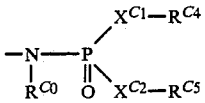

(XIV)

In the formulae (XII) and (XIV), $R^{CO}$ represents a hydrogen atom, an optionally substituted alkyl group having from 1 to 12 carbon atoms (e.g., methyl, ethyl, propyl, butyl, hexyl, octyl, decyl, dodecyl, 2chloroethyl, 2-bromoethyl, 2-chloropropyl, 2-cyanoethyl, 2-methoxyethyl, 2-ethoxyethyl, 2-methoxycarbonylethyl, 3-methoxypropyl, 6-chlorohexyl), an alicyclic group having from 5 to 8 carbon atoms (e.g., cyclopentyl, cyclohexyl), an optionally substituted aralkyl group having from 7 to 12 carbon atoms (e.g., benzyl, phenethyl, 3-phenylpropyl, 1-phenylpropyl, chlorobenzyl, methoxybenzyl, bromobenzyl, methylbenzyl) or an optionally substituted aryl group having from 6 to 12 carbon atoms (e.g., phenyl, chlorophenyl, dichlorophenyl, tolyl, xylyl, mesityl, chloromethyl, chlorophenyl, methoxyphenyl, ethoxyphenyl, chloromethoxyphenyl).

When $R^{CO}$ represents a hydrocarbon group, such preferably has from 1 to 8 carbon atoms.

In the functional group of formula (XII), $R^{C1}$ represents an optionally substituted aliphatic group having from 2 to 12 carbon atoms, more specifically group of the following formula (XV):

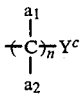

(XV)

where $a_1$ and $a_2$ each represents a hydrogen atom, a halogen atom (e.g., chlorine, fluorine) or an optionally substituted hydrocarbon group having from 1 to 12 carbon atoms (e.g., methyl, ethyl, propyl, butyl, hexyl, methoxyethyl, ethoxymethyl, 2-methoxyethyl, 2-chloroethyl, 3-bromopropyl, cyclohexyl, benzyl, chlorobenzyl, methoxybenzyl, methylbenzyl, phenethyl, 3-phenylpropyl, phenyl, tolyl, xylyl, mesityl, chlorophenyl, methoxyphenyl, dichlorophenyl, chloromethylphenyl, naphthyl); $Y^c$ represents a hydrogen atom, a halogen atom (e.g., fluorine, chlorine), a cyano group, an alkyl group having from 1 to 4 carbon atoms (e.g., methyl, ethyl, propyl, butyl), an optionally substituted aromatic group having 6 to 12 carbon atoms (e.g., phenyl, tolyl, cyanophenyl, 2,6-dimethylphenyl, 2,4,6-trimethylphenyl, pentamethylphenyl, 2,6-dimethoxyphenyl, 2,4,6-trimethoxyphenyl, 2-propylphenyl, 2-butylphenyl, 2-chloro-6methylphenyl, furanyl) or $—SO_2—R^{C6}$ (in which $R^{C6}$ has the same meaning as the hydrocarbon group of $Y^C$); and n represents 1 or 2.

More preferably, when $Y^C$ represents a hydrogen atom or an alkyl group, $a_1$ and $a_2$ on the carbon atom adjacent to the oxygen atom of the urethane bond are substituents other than a hydrogen atom.

When $Y^C$ is not a hydrogen atom or an alkyl group, $a_1$ and $a_2$ may be any of the above-mentioned groups. Specifically, $R^{C1}$ of

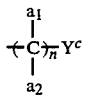

forms a group containing at least one or more electron-attracting groups or is a group in which the carbon adjacent to the oxygen atom of the urethane bond forms a stereostructurally high bulky group, as preferred examples.

Alternatively, $R^{C1}$ represents an alicyclic group, for example, a mono-cyclic hydrocarbon group (e.g., cyclopropyl, cyclobutyl, cyclopentyl, cyclohexyl, 1-methyl-cyclohexyl, 1-methylcyclobutyl) or a cross-linked cyclic hydrocarbon group (e.g., bicyclooctane, bicyclooctene, bicyclononane, tricycloheptane).

In the formula (XIII), $R^{C2}$ and $R^{C3}$ may be the same or different and each represents a hydrocarbon group having from 1 to 12 carbon atoms, for example, an aliphatic group or an aromatic group such as the group of $Y^C$ in the formula (XII).

In the formula (XIV), $X^{C1}$ and $X^{C2}$ may be the same or different and each represents an oxygen atom or a sulfur atom. $R^{C4}$ and $R^{C5}$ may be the same or different and each represents a hydrocarbon group having from 1 to 8 carbon atoms, for examplé, an aliphatic group or an aromatic group such as the group of $Y^C$ in the formula (XII).

Specific examples of the functional groups of the formulae (XII) to (XIV) are mentioned below, which, however, are not intended to restrict the scope of the present invention.

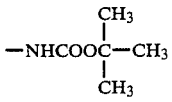
(79)

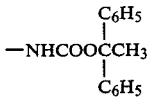
(80)

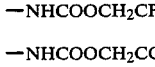
(81)

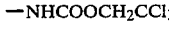
(82)

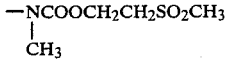
(83)

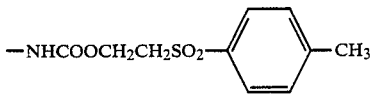
(84)

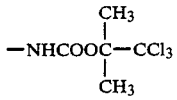
(85)

-continued

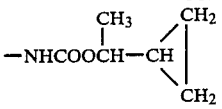
(86)

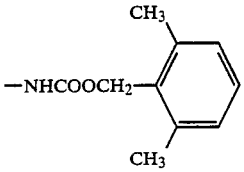
(87)

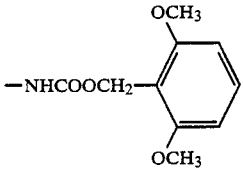
(88)

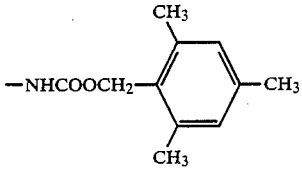
(89)

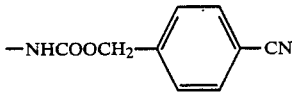
(90)

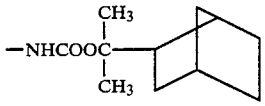
(91)

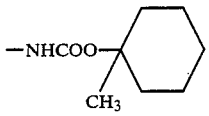
(92)

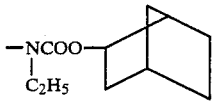
(93)

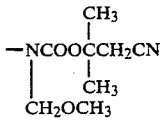
(94)

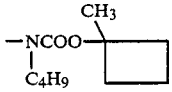
(95)

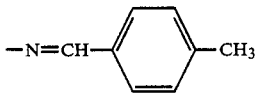
(96)

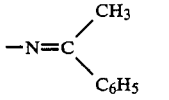
(97)

-continued (98)

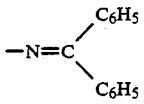

(99)

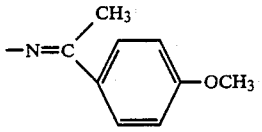

(100)

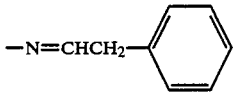

(101)

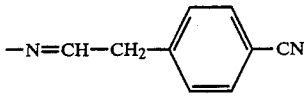

(102)

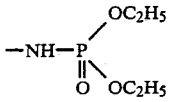

(103)

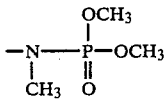

(104)

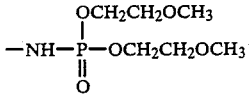

(105)

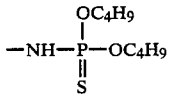

Resins having at least one functional group capable of forming an amino group (for example —$NH_2$ and/or —$NHR^{CO}$) by decomposition, for example, at least one functional group selected from the groups of the aforesaid formulae (XII) to (XIV), for use in the present invention can be prepared, for example, in accordance with the methods described in the literature as referred to in *Shin-jikken Kagaku Koza* (*New Lecture of Experimental Chemistry*), Vol. 14, page 2555 published by Maruzen), J. F. W. McOmie, *Protective Groups in Organic Chemistry,* Chap. 2 (published by Plenum Press, 1973) or *Protective Groups in Organic Synthesis,* Chap. 7 (published by John Wiley & Sons, 1981).

The method of preparing the resins from monomers previously containing the functional group of any one of the formulae (XII) to (XIV) by polymerization reaction is preferred, because polymers having the functional group of any one of the formulae (XII) to (XIV) may freely be prepared or no impurities are introduced into the polymers formed. Specifically, the primary or secondary amino group in a primary or secondary amine containing a polymerizable double bond is converted into a functional group of any one of the formulae (XII) to (XV) in accordance with the method described in the above literature, and then the resulting amine is polymerized.

Examples of the functional group capable of forming at least one sulfo group (—$SO_3H$) by decomposition includes functional groups of the following formulae (XVI) or (XVII).

$$-SO_2-O-R^{D1} \quad \text{(XVI)}$$

$$-SO_2-S-R^{D2} \quad \text{(XVII)}$$

In the formula (XVI), $R^{D1}$ represents

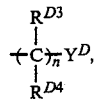

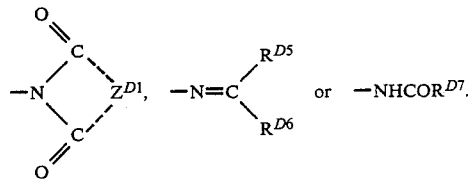

In the formula (XVII), $R^{D2}$ represents an optionally substituted aliphatic group having from 1 to 18 carbon atoms or an optionally substituted aryl group having from 6 to 22 carbon atoms.

The functional group as represented by the formula (XVI) or (XVII) forms a sulfo group by decomposition, and this is explained in detail hereunder.

When $R^{D1}$ represents

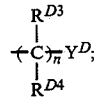

$R^{D3}$ and $R^{D4}$ may be the same or different and each represents a hydrogen atom, a halogen atom (e.g., fluorine, chlorine, bromine), an alkyl group having from 1 to 6 carbon atoms (e.g., methyl, ethyl, propyl, butyl, pentyl, hexyl) or an aryl group having from 6 to 12 carbon atoms (e.g., phenyl). $Y^D$ represents an optionally substituted alkyl group having from 1 to 18 carbon atoms (e.g., methyl, ethyl, propyl, butyl, pentyl, hexyl, octyl, decyl, dodecyl, hexadecyl, trifluoromethyl, methanesulfonylmethyl, cyanomethyl, 2-methoxyethyl, ethoxymethyl, chloromethyl, dichloromethyl, trichloromethyl, 2-methoxycarbonylethyl, 2-propoxycarbonylethyl, methylthiomethyl, ethylthiomethyl), an optionally substituted alkenyl group having from 2 to 18 carbon atoms (e.g., vinyl, allyl), an optionally substituted aryl group having from 6 to 12 carbon atoms (e.g., phenyl, naphthyl, nitrophenyl, dinitrophenyl, cyanophenyl, trifluoromethylphenyl, methoxycarbonylphenyl, butoxycarbonylphenyl, methanesulfonylphenyl, benzenesulfonylphenyl, tolyl, xylyl, acetoxyphenyl, nitronaphthyl) or

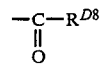

(in which $R^{D8}$ represents an aliphatic group or an aromatic group, examples of which include the groups described for group $Y^D$). n represents 0, 1 or 2.

More preferably, the substituent

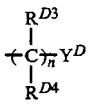

is a functional group containing at least one electron-attracting group. Specifically, when n is 0 and $Y^D$ is a hydrocarbon group containing no electron-attracting group, the substituent

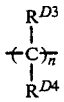

contains at least one or more halogen atoms. Alternatively, n is 0, 1 or 2, and $Y^D$ contains at least one electron-attracting group. Further, n is 1 or 2, and the group

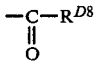

corresponds to

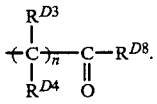

The electron-attracting group means a substituent having a positive Hammett's substituent constant, for example, including a halogen atom —COO—,

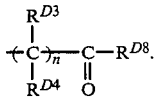

The electron-attracting group means a

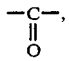

$—SO_2—$, —CN, $—NO_2$ and the like.

A still another preferred substituent of $—SO_2—O—R^{D1}$ is one where the carbon atom adjacent to the oxygen atom in the formula is substituted by at least two hydrocarbon groups, or when n is 0 or 1 and $Y^D$ is an aryl group, the 2-position and 6-position of the aryl group have substituents.

When $R^{D1}$ represents

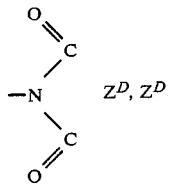

represents an organic residue forming a cyclic imido group. Preferably, this represents an organic group of the following formulae (XVIII) or (XIX).

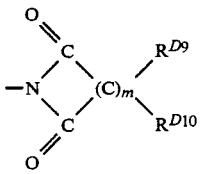

(XVIII)

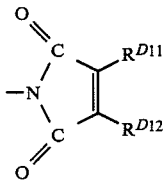

(XIX)

In the formula (XVIII), $R^{D9}$ and $R^{D10}$ may be the same or different and each represents a hydrogen atom, a halogen atom (e.g., chlorine, bromine), an optionally substituted alkyl group having from 1 to 18 carbon atoms (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, 2-(ethoxyoxy)ethyl), an optionally substituted aralkyl group having from 7 to 12 carbon atoms (e.g., benzyl, phenethyl, 3-phenylpropyl, methylbenzyl, dimethylbenzyl, methoxybenzyl, chlorobenzyl, bromobenzyl) or an optionally substituted alkenyl group having from 3 to 18 carbon atoms (e.g., allyl, 3-methyl2-propenyl).

When $R^{D1}$ represents

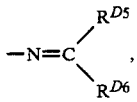

$R^{D5}$ and $R^{D6}$ each represents a hydrogen atom, an aliphatic group (examples of which include those for $R^{D5}$ and $R^{D6}$ or an aryl group (examples of which include those for $R^{D3}$ and $R^{D4}$), provided that both $R^{D5}$ and $R^{D6}$ must not be hydrogens at the same time.

When $R^{D1}$ represents $—NHCOR^{D7}$, $R^{D7}$ represents an aliphatic group or an aryl group, examples of which include those for $R^{D3}$ and $R^{D4}$.

In the formula (XVII), $R^{D2}$ represents an optionally substituted aliphatic group having from 1 to 18 carbon atoms or an optionally substituted aryl group having from 6 to 22 carbon atoms.

More specifically, $R^{D2}$ in the formula (XVII) represents an aliphatic group or an aryl group, examples of which include those for $Y^D$ in the formula (XVI).

The resins containing at least one functional group selected from the groups consisting of ($—SO_2—O—R^{D1}$) and ($—SO_2—O—R^{D2}$), for use in the present invention, can be prepared by a method of converting the sulfo group in a polymer into a functional group of the formula (XVI) or (XVII) by polymer reaction, or by a method of polymerizing one or more monomers containing one or more functional groups of the formula (XVI) or (XVII) or copolymerizing the monomer and a copolymerizable monomer.

The method of converting the sulfo group into the functional group can be conducted in the same manner for preparing the functional group-containing monomers, also in a polymer reaction.

Specific examples of the functional groups of the formulae (XVI) $—SO_2—O—R^{D1}$ and (XVII) $—SO_2—S—R^{D2}$ are the following groups, which, however, are not intended to restrict the scope of the present invention.

(106)

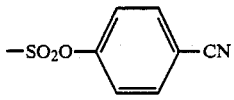

(107)

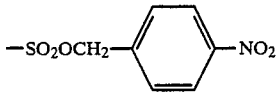

$—SO_2OCH_2CF_3$ (108)

(109)

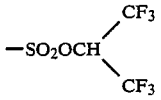

$—SO_2OCH_2(CHF)_2CH_2F$ (110)

$—SO_2OCH_2CCl_3$ (111)

(112)

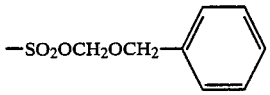

$—SO_2O(CH_2)_2SO_2C_4H_9$ (113)

(114)

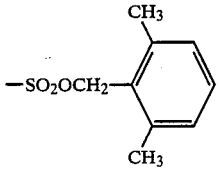

(115)

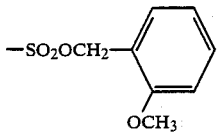

(116)

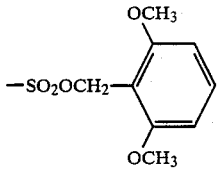

(117)

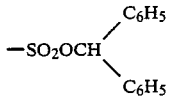

(118)

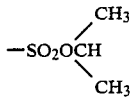

(119)

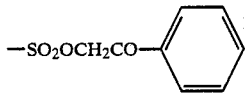

-continued (120)

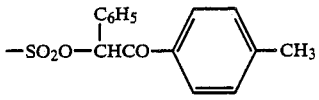

(121)

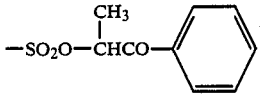

(122)

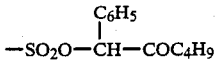

$—SO_2O(CH_2)_2SO_2C_2H_5$ (123)

$—SO_2SC_4H_9$ (124)

$—SO_2SC_6H_{13}$ (125)

$—SO_2S(CH_2)_2OC_2H_5$ (126)

(127)

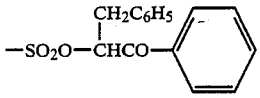

$—SO_2OCH_2CHFCH_2F$ (128)

(129)

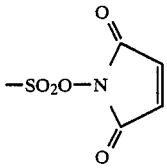

(130)

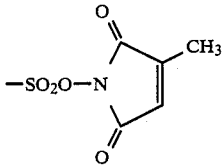

(131)

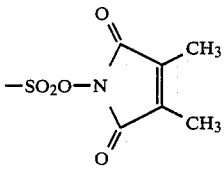

(132)

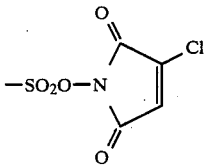

(133)

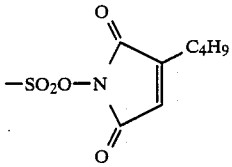

(134)

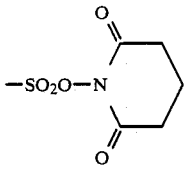

-continued (135)

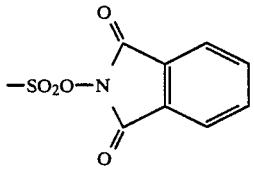

(136)

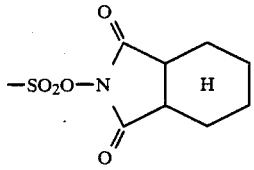

(137)

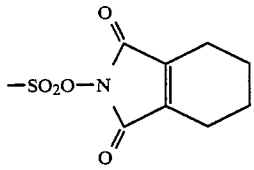

(138)

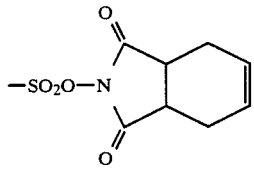

Specific, but not limiting, examples of the copolymer constituents containing the functional groups of the general formula (I) to (VII), (X) to (XIV), (XVI) and (XVII), used in the method of preparing a desired resin through the polymerization reaction according to the third preferred embodiment of the present invention as described above, include those represented by the following general formula (A):.

(A)

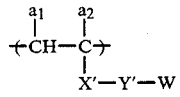

wherein X' represents —O—, —CO—, —COO—, —OCO—,

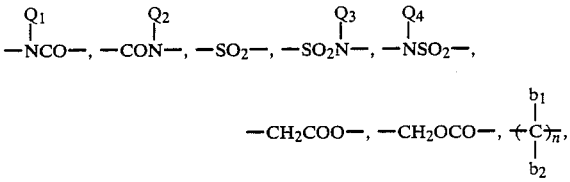

an aromatic group, or a heterocyclic group (wherein $Q_1$, $Q_2$, $Q_3$ and $Q_4$ each represent a hydrogen atom, a hydrocarbon group or the moiety —Y'—W in the formula (VI); $b_1$ and $b_2$ may be the same or different, each being a hydrogen atom, a hydrocarbon group or the moiety —Y'—W in the formula (VI); and n is an integer of from 0 to 18); Y' represents a carbon-carbon bond for connecting the linkage group X' to the functional group —W, between which hetero atoms (including oxygen, sulfur and nitrogen atoms) may be present, which specific examples are

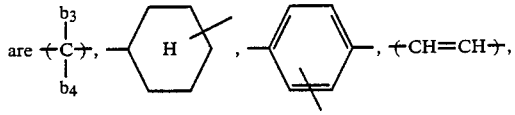

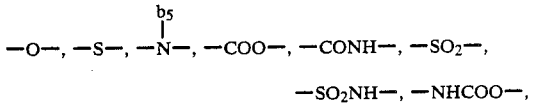

and —NHCONH—, individually or in combination (wherein $b_3$, $b_4$ and $b_5$ each have the same meanings as the foregoing $b_1$ and $b_2$); W represents the functional group represented by the formulae (I) to (VII), (X) to (XIV), (XVI) or (XVII); and $a_1$ and $a_2$ may be the same or different, each being a hydrogen atom, a halogen atom (e.g., chlorine, bromine atom), a cyano group, a hydrocarbon residue (e.g., an optionally substituted alkyl group containing 1 to 12 carbon atoms, such as methyl, ethyl, propyl, butyl, methoxycarbonyl, ethoxycarbonyl, propoxycarbonyl, butoxycarbonyl, hexyloxycarbonyl, methoxycarbonylmethyl, ethoxycarbonylmethyl, butoxycarbonylmethyl, etc., an aralkyl group such as benzyl, phenethyl, etc., and an aryl group such as phenyl, tolyl, xylyl, chlorophenyl, etc.), or an alkyl group containing 1 to 18 carbon atoms, an alkenyl group, an aralkyl group, an alicyclic group or an aromatic group, which may be substituted by a substituent containing the moiety —W in the formula (A).

In addition, the linkage moiety —X'—Y'— in the formula (A) may directly connect the moiety

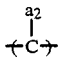

to the moiety —W.

Furthermore, the resins of this embodiment contain not only monomers containing the functional groups of the foregoing general formulae (I) to (VII), (X) to (XIV), (XVI) and/or (XVII), but also other monomers, as copolymer constituents, for example, α-olefins, vinyl or allyl esters of alkanic acids, acrylonitrile, methacrylonitrile, vinyl ethers, acrylamides, methacrylamides, styrenes, heterocyclic vinyl compounds such as vinylpyrrolidone, vinylpyridine, vinylimidazole, vinylthiophene, vinylimidazoline, vinylpyrazole, vinyldioxane, vinylquinone, vinylthiazole, vinyloxazine and the like. Above all, vinyl acetate, allyl acetate, acrylonitrile, methacrylonitrile and styrenes are preferably used from the standpoint of increasing the film strength.

In the resin of the present invention, at least a part of the polymer can be crosslinked. Such a resin that at least a part of the polymer is previously crosslinked (resin having a crosslinked structure in the polymer) is preferably a resin which is hardly soluble or insoluble in acidic or alkaline aqueous solutions when the foregoing polar or hydrophilic group-producing functional group contained in the resin is decomposed to form the polar or hydrophilic group. Specifically, the solubility of the resin in distilled water at 20° to 25° C. is preferably at most 90% by weight, more preferably at most 70% by weight.

Introduction of a crosslinked structure in a polymer can be carried out by known methods, that is, (1) a method comprising incorporating functional groups for effecting a crosslinking reaction in the polymer containing functional groups capable of forming polar or hydrophilic groups through decomposition and crosslinking the polymer containing both the functional groups with various crosslinking agents or hardening agents and (2) a method comprising subjecting the above described polymer to polymerization reaction (i.e., method comprising crosslinking by a high molecular reaction or method comprising effecting the polymerization reaction of as polymer containing at least one monomer corresponding to the polymer constituent containing the functional group capable of forming the polar or hydrophilic group through decomposition in the presence of a multifunctional monomer or multifunctional oligomer containing two or more polymerizable functional groups, thereby effecting crosslinking among the molecules).

In the present invention, the functional group for effecting a crosslinking reaction can be any of ordinary polymerizable bond groups and reactive groups to be linked by chemical reactions.

Examples of the polymerizable double bond group are

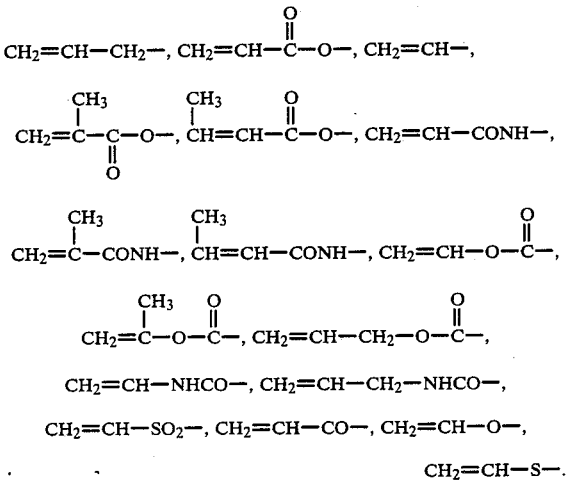

The crosslinking of the polymers by reacting the reactive groups with each other to form chemical bonds can be carried out in the similar manner to the ordinary reactions of organic low molecular compounds, for example, as disclosed in Yoshio Iwakura and Keisuke Kurita "Relative Polymers (Hannosei Kobunshi)" published by Kohdansa (1977) and Ryohei Oda "High Molecular Fine Chemical (Kobunshi Fine Chemical)" published by Kohdansa (1976). Combination of functional groups classified as Group A (hydrophilic polymeric component) and functional groups classified as Group B (polymers comprising components containing reactive groups)in the following Table 1 has well been known for effectively accomplishing the polymer reactions.

TABLE 1

| Group A | Group B |
|---|---|
| —COOH, —$PO_3H_2$ | 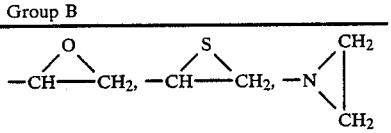 |
| —OH, —SH<br>—$NH_2$ | —COCl, —$SO_2Cl$,<br>cyclic acid anhydride |

TABLE 1-continued

| Group A | Group B |
|---|---|
| —$SO_2H$ | —N=C=O, —N=C=S,<br> 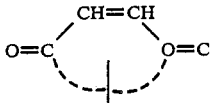 <br> 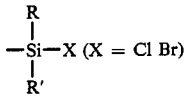 |

In addition, as the reactive group, there can be used —$CONHCH_2OR$ wherein R represents a hydrogen atom or an alkyl group such as methyl, ethyl, propyl or butyl group, which has been known as a group for linking by a self-condensation type reaction.

As the crosslinking agent in the present invention, there can be used compounds commonly used as crosslinking agents, for example, described in Shinzo Yamashita and Tosuke Kaneko "Handbook of Crosslinking Agents (Kakyozai Handbook)" published by Taiseisha (1981) and Kobunshi Gakkai Edition "High Molecular Data Handbook -Basis- (Kobunshi Data Handbook -Kisohen-)" published by Baihunkan (1986).

Examples of the crosslinking agent are organosilane compounds such as vinyltrimethoxysilane, vinyltributoxysilane, γ-glycidoxypropyltrimethoxysilane, γ-mercaptopropyltriethoxysilane, γ-aminopropyltriethoxysilane and other silane coupling agents; polyisocyanate compounds such as tolylene diisocyanate, o-tolylene diisocyanate, diphenylmethane diisocyanate, triphenylmethane diisocyanate, polymethylenepolyphenyl isocyanate, hexamethylene diisocyanate, isophorone diisocyanate, high molecular polyisocyanate; polyol compounds such as 1,4-butanediol, polyoxypropylene glycol, polyoxyalkylene glycol, 1,1,1-trimethylolpropane and the like; polyamine compounds such as ethylenediamine, γ-hydroxypropylated ethylenediamine, phenylenediamine, hexamethylenediamine, N-aminoethylpiperazine, modified aliphatic polyamines and the like; polyepoxy group-containing compounds and epoxy resins, for example, as described in Kakiuchi Hiroshi "New Epoxy Resins (Shin Epoxy Jushi)" published by Shokodo (1985), and Kuniyuki Hashimoto "Epoxy Resins (Epoxy Jushi)" published by Nikkan Kogyo Shinbunsha (1969); melamine resins such as described in Ichiro Miwa and Hideo Matsunaga "Urea and Melamine Resins (Urea-Melamine Jushi)" published by Nikkan Kogyo Shinbunsha (1969); and poly(-meth)acrylate compounds as described in Shin Ogawara, Takeo Saegusa and Toshinobu Higashimura "Oligomers" published by Kodansha (1976) and Eizo Omori "Functional Acrylic Resins" published by Technosystem (1985), for example, polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and methacrylates thereof and the like.

Of the multifunctional monomers or oligomers having two or more polymerizable functional groups, used in the above described polymerization reaction, examples of the monomer or oligomer having two or more same polymerizable functional groups are styrene derivatives such as divinyl benzene and trivinyl benzene; esters of polyhydric alcohols such as ethylene glycol, diethylene glycol, triethylene glycol, polyethylene glycols Nos. 200, 400 and 600, 1,3-butylene glycol, neopentyl glycol, dipropylene glyclol, polypropylene glycol, trimethylolpropane, trimethylolethane, pentaerythritol and the like or polyhydroxyphenols such as hydroquinone, resorcinol, catechol and derivatives thereof with methacrylic acid, acrylic acid or crotonic acid, vinyl ethers and allyl ethers; vinyl esters of dibasic acids such as malonic acid, succinic acid, glutaric acid, adipic acid, pimelic acid, maleic acid, phthalic acid, itaconic acid and the like, allyl esters, vinylamides and allylamides; and condensates of polyamines such as ethylenediamine, 1,3-propylenediamine, 1,4-butylenediamine and the like with carboxylic acids containing vinyl groups such as methacrylic acid, acrylic acid, crotonic acid, allylacetic acid and the like.

As the multifunctional monomer or oligomer having two or more different polymerizable functional groups, there can be used, for example, ester derivatives or amide derivatives containing vinyl groups of carboxylic acids containing vinyl group, such as methacrylic acid, acrylic acid, methacryloylacetic acid, acryloylacetic acid, methacryloylpropionic acid, acryloylpropionic acid, itaconyloylacetic acid and itaconyloylpropionic acid, reaction products of carboxylic anhydrides with alcohols or amines such as allyloxycarbonylpropionic acid, allyloxycarbonylacetic acid, 2-allyloxycarbonylbenzoic acid, allylaminocarbonylpropionic acid and the like, for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, 2-(vinyloxycarbonyl)ethyl ester of acrylic acid, N-allylacrylamide, N-allylmethacrylamide, N-allylitaconamide, methcaryloylpropionic acid allylamide and the like; and condensates of amino alcohols such as aminoethanol, 1-aminopropanol, 1-aminobutanol, 1-aminohexanol, 2-aminobutanol and the like with carboxylic acids containing vinyl groups.

The monomer or oligomer containing two or more polymerizable functional groups of the present invention is generally used in a proportion of at most 10 mole %, preferably at most 5 mole % to all monomers, which is polymerized to form a resin.

As illustrated above, the resin groups of the present invention contain polymeric constituents or repeating units containing functional groups capable of forming polar or hydrophilic groups through decomposition and optionally have such a structure that the interior of the resin is crosslinked.

The resin grains of the present invention, having a fine grain diameter, can be given a desired grain size by jointly dispersing the resin grains when preparing a photoconductive layer-forming composition. Alternatively, a method of forming fine grains by dry or wet process or a method of obtaining high molecular gel latexes can be employed as well known in the art.

That is, there are, for example, (a) a method comprising directly pulverizing the resin powder by means of a pulverizing mill or dispersing mill of the prior art, such as ball mill, paint shaker, sound mill, hammer mill, jet mill, kedy mill, etc. and thus obtaining fine grains, and (b) a method of obtaining high molecular latex grains. The latter method of obtaining high molecular latex grains can be carried out according to the prior art method for producing latex grains of paints or liquid developers for electrophotography. That is, this method comprises dispersing the resin by the joint use of a dispersing polymer, more specifically previously mixing the resin and dispersion aid polymer, followed by pulverizing, and then dispersing the pulverized mixture in the presence of the dispersing polymer.

For example, these methods are described in "Flowing and Pigment Dispersion of Paints" translated by Kenji Ueki and published by Kyoritsu Shuppan (1971), Solomon "Chemistry of Paints", "Paint and Surface Coating Theory and Practice", Yuji Harasaki "Coating Engineering (Coating Kogaku)" published by Asakura Shoten (1971), Yuji Harasaki "Fundamental Science of Coating (Kiso Kagaku of Coating)" by Maki Shoten (1977) and Japanese Patent Laid-Open Publication Nos. 96954/1987, 115171/1987 and 75651/1987.

Furthermore, the prior art method of obtaining readily latex grains or particles by suspension polymerization or dispersion polymerization can also be used in the present invention, for example, as described in Soichi Muroi "Chemistry of High Molecular Latex (Kobunshi Latex no Kagaku)" published by Kobunshi Kankokai (1970), Taira Okuda and Hiroshi Inagaki "Synthetic Resin Emulsions (Gosei Jushi Emulsion)" published by Kobunshi Kankokai (1978), Soichi Muroi "Introduction to High Molecular Latexes (Kobunshi Latex Nyumon)" published by Kobunsha (1983).

In the present invention, it is preferable to use a method of obtaining high molecular latex grains, whereby resin grains with an average grain diameter of at most 1.0 μm can readily be obtained.

In the electrophotographic lithographic printing plate precursor of the present invention, formation of a photoconductive layer can be carried out by any of methods of dispersing photoconductive zinc oxide in an aqueous system, for example, described in Japanese Patent Publication Nos. 450/1976, 18599/1972 and 41350/1971 and methods of dispersing in a non-aqueous solvent system, for example, described in Japanese Patent Publication No. 31011/1975 and Japanese Patent Laid-Open Publication Nos. 54027/1978, 20735/1979, 202544/1982 and 68046/1983. If water remains in the photoconductive layer, however, the electrophotographic property is deteriorated, and accordingly, the latter methods using a non-aqueous solvent system is preferable. Therefore, in order to adequately disperse the latex grains of the present invention in the photoconductive layer dispersed in a non-aqueous system, the latex grains are preferably non-aqueous system latex grains.

As the non-aqueous solvent for the non-aqueous system latex, there can be used any of organic solvents having a boiling point of at most 200° C., individually or in combination. Useful examples of the organic solvent are alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing 6 to 14 carbon atoms such as hexane, octane, decane, dodecane, tridecane, cyclohexane and cyclooctane, aromatic hydrocarbons such as benzene, toluene, xylene and chlorobenzene and halogenated hydrocarbons such as methylene chloride, dichloroethane, tetrachloroethane, chloroform, methylchloroform, dichloropropane and trichloroethane.

When a high molecular latex is synthesized by the dispersion polymerization method in a non-aqueous solvent system, the average grain diameter of the latex grains can readily be adjusted to at most 1 μm while simultaneously obtaining grains of monodisperse system with a very narrow distribution of grain diameters. Such a method is described in, for example, K. E. J. Barrett "Dispersion Polymerization in Organic Media" John Wiley & Sons (1975), Koichiro Murata "Polymer Processings (Kobunshi Kako)" 23, 20 (1974), Tsunetaka Matsumoto and Toyokichi Tange "Journal of Japan Adhesive Association (Nippon Setchaku Kyokaishi)" 9, 183 (1973), Toyokichi Tange "Journal of Japan Adhesive Association" 23, 26 (1987), D. J. Walbridge "NATO. Adv. Study Inst. Ser. E." No. 67, 40 (1983), British Pat. Nos. 893,429 and 934,038 and U.S. Pat. Nos. 1,122,397, 3,900,412 and 4,606,989, and Japanese Patent Laid-Open Publication Nos. 179751/1985 and 185963/1985.

The resin grains of the present invention have the functional groups protecting the polar or hydrophilic groups, i.e., functional groups capable of forming the polar or hydrophilic groups through decomposition, as described above, whereby the strong interaction of the resin grains with zinc oxide grains are suppressed and on the other hand, the polar groups, i.e., hydrophilic groups are formed by an oil-desensitizing treatment to improve the hydrophilic property of a non-image area.

Since the resin grains of the present invention have a crosslinking structure in a part of the polymer as the more preferred embodiment, furthermore, the resin containing the polar groups formed by an oil-desensitizing treatment, in a precursor, is prevented from being water-soluble and dissolving out of a non-image area, while maintaining the hydrophilic property. Therefore, the hydrophilic property of the non-image area can further be enhanced by the polar groups formed in the resin and moreover, the durability of this effect can be improved.

In a prior patent application (Japanese Patent Laid-Open Publication No. 21269/1987) in which the foregoing resin containing the functional groups capable of forming carboxyl groups through decomposition is used as a part of the binder resin, the resin is dispersed under molecular state. In the present invention, on the other hand, the resin is dispersed under granular state with a fine grain diameter, so that the polar groups can more readily be formed by an oil-desensitizing treatment and the hydrophilic degree due to the thus formed polar groups can more be increased, as compared with the prior invention. This is probably due to that the specific area is more increased when the resin is dispersed in the form of fine grains with a fine grain size than dispersed under molecular state.

As illustrated above, the resin grains according to the present invention which contains at least one functional group capable of forming a polar group through decomposition is hydrolyzed or hydrogenolyzed upon contact with an oil-desensitizing solution or dampening water used during printing thereby to form the polar group.

In a lithographic printing plate precursor of the present invention, containing the resin grains in a photoconductive layer, therefore, the hydrophilic property of a non-image area to be rendered hydrophilic by an oil-desensitizing solution can be enhanced by the thus formed polar group in the resin grains and consequently, a marked contrast can be provided between the lipophilic property of the image area and the hydrophilic property of the non-image area to prevent adhesion of a printing ink onto the non-image area during printing. Thus, provision of a lithographic printing plate precursor capable of producing a large number of prints having a clear image free from background stains has now been realized.

In the case of the above described resin grains, at least a part of which is crosslinked, the water solubility is markedly lowered while maintaining the hydrophilicity, so that it be hardly soluble or insoluble in water. Thus, the hydrophilic property of a non-image area can further be enhanced by the polar groups of the resin and the durability is improved. This results in the specific effects or merits that even if the quantity of the above described functional groups in the resin is decreased, the effect of the improved hydrophilic property can be maintained unchanged and even if printing conditions become severer, for example, a printing machine is large-sized or printing pressure is fluctuated, a large number of prints with a clear image quality and free from background stains can be obtained.

As the binder resin of the present invention, there can be used all of known resins, typical of which are vinyl chloride-vinyl acetate copolymers, styrene butadiene copolymers, styrene-methacrylate copolymers, methacrylate copolymers, acrylate copolymers, vinyl acetate copolymers, polyvinyl butyral, alkyd resins, silicone resins, epoxy resins, epoxyester resins, polyester resins and the like, as described in Takaharu Kurita and Jiro Ishiwataru "High Molecular Materials (Kobunshi)" 17, 278 (1968), Harumi Miyamoto and Hidehiko Takei "Imaging" No. 8, page 9 (1973), Koichi Nakamura "Practical Technique of Binders for Recording Materials (Kiroku Zairyoyo Binder no Jissai Gijutsu)" Section 10, published by C. M. C. Shuppan (1985), D. D. Tatt, S. C. Heidecker "Tappi" 49, No. 10, 439 (1966), E. S. Baltazzi, R. G . Blanckette et al. "Photo Sci. Eng." 16, No. 5, 354 (1972), Nguyen Chank Khe, Isamu Shimizu and Eiichi Inoue "Journal of Electrophotographic Association (Denshi Shashin Gakkaishi)" 18, No. 2, 28 (1980), Japanese Patent Publication No. 31011/1975, Japanese Patent Laid-Open Publication Nos. 54027/1978, 20735/1979, 202544/1982 and 68046/1983.

More specifically, there are given (meth)acrylic oopolymers containing at least 30% by weight, based on the total amount of the copolymer, of a monomer represented by the following general formula (B) as a copolymeric constituent and homopolymers of the monomer represented by the general formula (B):

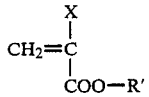

(B)

wherein X is hydrogen atom, a halogen atom such as chlorine or bromine atom, cyano group, an alkyl group containing 1 to 4 carbon atoms, or $-CH_2COOR''$ wherein R'' is an alkyl group containing 1 to 6 carbon atoms, which can be substituted, such as methyl, ethyl, propyl, butyl, heptyl, hexyl, 2-methoxyethyl or 2-chloroethyl group, an aralkyl group containing 7 to 12 carbon atoms, which can be substituted, such as benzyl phenethyl, 3-phenylpropyl, 2-phenylpropyl, chlorobenzyl, bromobenzyl, methoxybenzyl or methylbenzyl group, or an aryl group containing 6 to 12 carbon atoms, which can be substituted, such as phenyl, tolyl, xylyl, chlorophenyl dichlorophenyl, methoxyphenyl, bromophenyl or naphthyl group, and R' is an alkyl group containing 1 to 18 carbon atoms, which can be substituted, such as methyl, ethyl, propyl, butyl, pentyl, hexyl, octyl, decyl, dodecyl, tridecyl, tetradecyl, 2-methoxyethyl or 2-ethoxyethyl group, an alkenyl group containing 2 to 18 carbon atoms, which can be substituted, such as vinyl, allyl, isopropenyl, butenyl, hexenyl, heptenyl or octenyl group, an aralkyl group containing 7 to 12 carbon atoms, which can be substituted, such as benzyl, phenethyl, methoxybenzyl, ethoxybenzyl or methylbenzyl group, a cycloalkyl group containing 5 to 8 carbon atoms, which can be substituted, such as cyclopentyl, cyclohexyl or cycloheptyl group, or an aryl group such as phenyl, tolyl, xylyl, mesityl, naphthyl, methoxyphenyl, ethoxyphenyl, chlorophenyl or dichlorophenyl group.

Examples of other monomers to be copolymerized with the monomer represented by the general formula (B) are vinyl or allyl esters of aliphatic carboxylic acids, such as vinyl acetate, vinyl propionate, vinyl butyrate, allyl acetate, allyl propionate and the like; unsaturated carboxylic acids such as crotonic acid, itaconic acid, maleic acid and fumaric acid, or esters or amides of these unsaturated carboxylic acids; styrene or styrene derivatives such as vinyltoluene and α-methylstyrene; α-olefins, acrylonitrile, methacrylonitrile, and vinyl group-substituted heterocyclic compounds such as N-vinylpyrrolidone.

The binder resin used in the present invention has preferably a molecular weight of $10^3$ to $10^6$, more preferably $5\times10^3$ to $5\times10^5$ and a glass transition point of −10° C. to 120° C., more preferably 0° C. to 85° C.

The above described binder resin serves to not only fix photoconductive zinc oxide and the foregoing resin grains capable of forming the polar group through decomposition in a photoconductive layer, but also combine closely the photoconductive layer with a support. If the quantity of the binder resin is too small, therefore, the fixing ad bonding strength is lowered, so that the printing durability as a printing plate is reduced and repeated use of the printing plate is impossible, while if too large, the printing durability and repeated use can be improved, but the electrophotographic property is deteriorated as described above.

In the present invention, therfore, 10 to 60% by weight, preferably 15 to 40% by weight of the above described binder resin is used to 100 parts by weight of photocoinductive zinc oxide.

In the present invention, if necessary, various coloring matters or dyes can be used as a spectro sensitizer, illustrative of which are carbonium dyes, diphenylmethane dyes, triphenylmethane dyes, xanthene dyes, phthalein dyes, polymethine dyes such as oxonol dyes, merocyanine dyes, cyanine dyes, rhodacyanine dyes, styryl dyes, etc. and phthalocyanine dyes which can contain metals, as described in Harumi Miyamoto and Hidehiko Takei, "Imaging" No. 8, page 12 (1973), C. Y. Young et al. "RCA Review" 15, 469 (1954), Kohei Kiyota et al. "Denki Tsushin Gakkai Ronbunshi" J63-C (No. 2), 97 (1980), Yuji Harasaki et al. "Kogyo Kagaku Zasshi" 66, 78 and 188 (1963) and Tadaaki Tani "Nippon Shashin Gakkaishi" 35, 208 (1972).

For example, those using carbonium dyes, triphenylmetahe dyes, xanthene dyes, or phthalein dyes are described in Japanese Patent Publication No. 452/1976, Japanese Patent Laid-Open Publication Nos. 90334/1975, 114227/1975, 39130/1978, 82353/1978 and 16456/1982 and U.S. Pat. Nos. 3,052,540 and 4,054,450.

As the polymethine dyes such as oxonol dyes, merocyanine dyes, cyanine dyes and rhodacyanine dyes, there can be sued dyes described in F. M. Harmmer "The Cyanine Dyes and Related Compounds" and specifically dyes described in U.S. Pat. Nos. 3,047,384, 3,110,591, 3,121,008, 3,125,447, 3,128,179, 3,132,942 and 3,622,317; British Pat. Nos. 1,226,892, 1,309,274 and 1,405,898; and Japanese Patent Publication Nos. 7814/1973 and 18892/1980.

The polymethine dyes capable of spectrally sensitizing near infrared radiations to infrared radiations with longer wavelengths of at least 700 nm are described in Japanese Patent Publication No. 41061/1976; Japanese Patent Laid-Open Publication Nos. 840/1972, 44180/1972, 5034/1974, 45122/1974, 46245/1982, 35141/1981, 157254/1982, 26044/1986 and 27551/1986; U.S. Pat. Nos. 3,619,154 and 4,175,956; and "Research Disclosure" 216, pages 117–118 (1982).

The photoreceptor of the present invention is excellent in that its performance is hardly fluctuated even if it is used jointly with various sensitizing dyes. Furthermore, various additives for electrophotographic light-sensitive layers, such as chemical sensitizers, well known in the art can jointly be used as occasion demands, for example, electron accepting compounds such as benzoquinone, chloranil, acid anhydrides, organic carboxylic acids and the like, described in the foregoing "Imaging" No. 8, page 12 (1973) and polyarylalkane compounds, hindered phenol compounds, p-phenylenediamine compounds and the like, described in Hiroshi Komon et al. "Latest Development and Practical Use of Photoconductive Materials and Light-Sensitive Materials (Saikin no Kododenzairyo to Kankotai no Kaihatsu to Jitsuyoka)" Sections 4 to 6, published by Nippon Kagaku Joho Shuppanbu (1986).

The amounts of these additives are not particularly limited, but are generally 0.0001 to 2.0% by weight based on 100 parts by weight of the photoconductive zinc oxide.

The thickness of the photoconductive layer is generally 1 to 100 μm, preferably 10 to 50 μm.

When in a photoreceptor of laminate type consisting of a charge generating layer and charge transporting layer, a photoconductive layer is used as the charge producing layer, the thickness of the charge producing layer is generally 0.01 to 1 μm, preferably 0.05 to 0.5 μm.

The photoconductive layer of the present invention can be provided on a support as well known in the art. Generally, a support for an electrophotographic light-sensitive layer is preferably electroconductive and as the electroconductive support, there can be used, as known in the art, metals or substrates such as papers, plastic sheets, etc. which are rendered electroconductive by impregnating low resistance materials therein, substrates whose back surface, opposite to the surface to be provided with a light-sensitive layer, is made electroconductive, which is further coated with at lest one layer for the purpose of preventing it from curling; the above described support provided with, on the surface thereof, a water proof adhesive layer; the above described support optionally provided with, on the surface layer, one or more pre-coat layer; and papers laminated with plastics which are made electroconductive, for example, by vapor deposition of Al or the like thereon. Examples of the substrates or materials which are electroconductive or rendered electroconductive are described in Yukio Sakamoto "Electrophotography (Denshi Shashin)" 14 (No. 1), pages 2 to 11 (1975), Hiroyuki Moriga "Introduction to Chemistry of Special Papers (Nyumon Tokushashi no Kagaku)" Kobunshi Kankokai (1975), M. F. Hoover "J. Macromol Sci. Chem." A-4 (6), pp. 1327–1417 (1970), etc.

Production of a lithographic printing plate using the electrophotographic lithographic printing plate precursor of the present invention can be carried out in known manner. That is, the electrophotographic lithographic printing plate precursor is electrostatically charged substantially uniformly in a dark place and imagewise exposed to form an electrostatic latent image by an exposing method, for example, by scanning exposure using a semiconductor laser, He Ne laser, etc., by reflection imagewise exposure using a xenon lamp, tungsten lamp, fluorescent lamp, etc. as a light source or by contact exposure through a transparent positive film. The resulting electrostatic latent image is developed with a toner by any of various known development methods, for example, cascade development, magnetic brush development, powder cloud development, liquid development, etc. Above all, the liquid development method capable of forming a fine image is particularly suitable for making a printing plate. The thus formed toner image can be fixed by a known fixing method, for example, heating fixation, pressure fixation, solvent fixation, etc.

The printing plate having the toner image, formed in this way, is then subjected to a processing for rendering hydrophilic the non-image area in conventional manner using the so-called oil-desensitizing solution. The oil-desensitizing solution of this kind include processing solutions containing, as a predominant component, cyanide compounds such as ferrocyanides or ferricyanides, cyanide-free processing solutions containing, as a predominant component, amine cobalt complexes, phytic acid or its derivatives or guanidine derivatives, processing solutions containing, as a predominant component, organic acids or inorganic acids capable of forming chelates with zinc ion, and processing solutions containing water-soluble polymers.

For example, the cyanide compound-containing processing solutions are described in Japanese Patent Publication Nos. 9045/1969 and 39403/1971 and Japanese Patent Laid-Open Publication Nos. 76101/1977, 107889/1982 and 117201/1979. The phytic acid or its derivatives-containing processing solutions are described in Japanese Patent Laid-Open Publication Nos. 83807/1978, 83805/1978, 102102/1978, 109701/1978, 127003/1978, 2803/1979 and 44901/1979. The metal complex-containing processing solutions are described in Japanese Patent Laid-Open Publication Nos. 104301/1978, 14013/1978 and 18304/1979 and Japanese Patent Publication No. 28404/1968. The inorganic acid- or organic acid-containing processing solutions are described in Japanese Patent Publication Nos. 13702/1964, 10308/1965, 28408/1968 and 26124/1965 and Japanese Patent Laid-Open Publication No. 118501/1976. The guanidine compound-containing processing solutions are described in Japanese Patent Laid-Open Publication No. 111695/1981. The water-soluble polymer containing processing solutions are described in Japanese Patent Laid-Open Publication Nos. 36402/1974, 126302/1977, 134501/1977, 49506/1978, 59502/1978 and 104302/1978 and Japanese Patent Publication Nos. 9665/1963, 22263/1964, 763/1965 and 2202/1965.

The oil-desensitizing treatment can generally be carried out at a temperature of about 10° C. to about 50° C., preferably from 20° C. to 35° C., for a period of not longer than about 5 minutes. Upon subjecting the oil-desensitizing treatment, the hydrophilic group-producing functional groups are converted into hydrophilic groups by hydrolysis or hydrogenolysis.

In any of the above described oil-desensitizing solutions, the zinc oxide in the surface layer as the photoconductive is ionized to be zinc ion which causes a chelation reaction with a compound capable of forming a chelate in the oil-desensitizing solution to form a zinc chelate compound. This is precipitated in the surface layer to render the non-image area hydrophilic.

Thus, the printing plate precursor of the present invention can be converted into a printing plate by the oil-desensitizing processing with an oil-desensitizing solution.

The present invention will now be illustrated in greater detail by way of examples, but it should be understood that the present invention is not limited thereto.

EXAMPLES

Preparation Example 1 of Latex Grains: L-1

A mixed solution of 95 g of dodecyl methacrylate, 5 g of acrylic acid and 200 g of toluene was heated to 70° C. while stirring under a nitrogen stream, and 1.5 g of azobis(isobutyronitrile) (referred to as A.I.B.N.) was added thereto and reacted for 8 hours. To this reaction mixture were added 12 g of glycidyl methacrylate, 1 g of t-butylhydroquinone and 0.8 g of N,N-dimethyldodecylamine, followed by allowing the mixture to react at 100° C. for 15 hours (Dispersed Resin I).

A mixture of 7 g (as solid content) of the above described Dispersed Resin I, 20 g of 2-cyanoethyl methacrylate, 30 g of the following monomer (M-1) and 200 g of n-octane was heated to 65° C. while stirring under a nitrogen stream, and 0.3 g of 2,2-azobis(isovaleronitrile) (referred to as A.I.V.N.) was then added thereto and reacted for 6 hours.

After passage of 20 minutes from the addition of the initiator (A.I.V.N.), the homogeneous solution became slightly opaque, the reaction temperature being raised to 90° C. After cooling, the reaction product was passed through a nylon cloth of 200 mesh to obtain a white dispersion having an average grain diameter of 0.35 μm as a white latex (L-1).

Monomer M-1

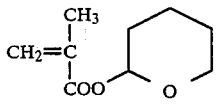

Preparation Examples 2 to 12 of Latex Grains: L-2 to L-12

The procedure of Preparation Example 1 was repeated except using 30 g of each of the following monomers shown in Table 2 instead of 30 g of the monomer M-1 of Preparation Example 1, thus preparing latex grains L-2 to L-12.

TABLE 2

| Preparation Examples | Latex Grains | Monomer (M) | | Average Grain Diameter (μm) |
|---|---|---|---|---|
| 2 | L-2 | 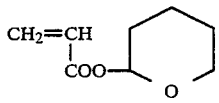 | M-2 | 0.3 |
| 3 | L-3 | 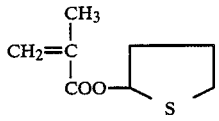 | M-3 | 0.3 |
| 4 | L-4 | 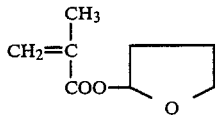 | M-4 | 0.25 |
| 5 | L-5 | 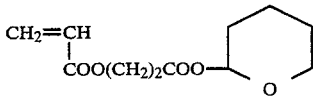 | M-5 | 0.2 |
| 6 | L-6 | 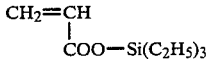 | M-6 | 0.25 |
| 7 | L-7 | 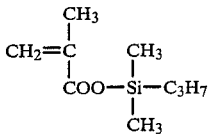 | M-7 | 0.3 |
| 8 | L-8 | 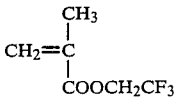 | M-8 | 0.25 |
| 9 | L-9 | 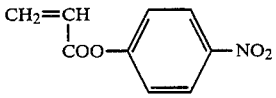 | M-9 | 0.35 |
| 10 | L-10 | 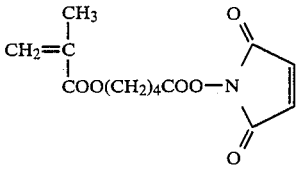 | M-10 | 0.35 |
| 11 | L-11 | 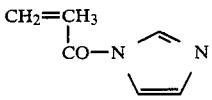 | M-11 | 0.3 |
| 12 | L-12 | 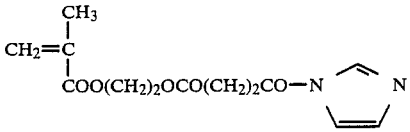 | M-12 | 0.2 |

Preparation Example 13 of Latex Grains: L-13

A mixture of 31.5 g of ethylene glycol, 51.8 g of phthalic anhydride, 6.0 g of methacrylic acid, 10 g of trichloroethylene and 0.7 g of p-toluenesulfonic acid was heated and reacted for 6 hours in such a manner that the reaction temperature was raised from 107° C. to 150° C. in 6 hours, while removing water byproduced by the reaction by the Dean-Stark method.

A mixture of 10 g of methyl methacrylate, 40 g of the following monomer M-13.5 g (as solid) of the thus resulting copolymer and 200 g of isodecane was heated at 70° C. under a nitrogen stream, to which 0.4 g of benzoyl peroxide was added, followed by subjecting the mixture to reaction for 4 hours.

After cooling, the reaction product was passed through a nylon cloth of 200 mesh to obtain a white dispersion with an average grain diameter of 0.18 μm.

Monomer M-13

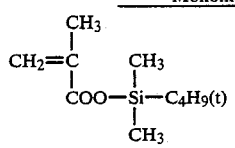

Preparation Example 14 of Latex Grains: L-14

A mixed solution of 8.5 g of poly(dodecyl methacrylate), 50 g of Monomer M-1 and 250 g of n-octane was heated at 65° C. under a nitrogen stream, to which 0.2 g of A.I.V.N. was added, followed by subjecting the mixture to reaction for 4 hours.

After cooling, the reaction product was passed through a nylon cloth of 200 mesh to obtain a dispersion with an average grain diameter of 0.30 μm, as latex.

Preparation Example 15 of Latex Grains: L-15

A mixture of 4 g of dodecyl methacrylate-acrylic acid copolymer (95/5 component ratio by weight), 30 g of the following monomer M-14 and 200 g of n-hexane was heated at 60° C. under a nitrogen stream, to which 0.2 g of A.I.V.N. was added, followed by reacting the mixture for 4 hours.

After cooling, the reaction product was passed through a nylon cloth of 200 mesh to obtain a dispersion as a latex with an average grain diameter of 0.35 μm.

Monomer M-14

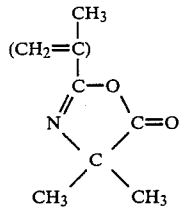

Example 1

A mixture of 200 g of photoconductive zinc oxide, 40 g of (ethyl methacrylate/acrylic acid) copolymer (weight component ratio 97/3, weight average molecular weight 63,000), 5 g (as solid content) of the latex grains (L-1) obtained in Preparation Example 1, 0.06 g of Rose Bengal and 300 g of toluene was ball milled for 2 hours. The thus resulting light-sensitive layer forming dispersion was applied to a paper rendered electrically conductive to give an adhered quantity on dry basis of 22 g/m$^2$ by a wire bar coater, followed by drying at 110° C. for 30 seconds. The thus coated paper was allowed to stand in a dark place at a temperature of 20° C. and a relative humidity of 65% for 24 hours to prepare an electrophotographic light-sensitive material.

Comparative Example 1

The procedure of Example 1 was repeated except not using 5 g of the latex grains (L-1) obtained in Preparation Example 1 to prepare an electrophotographic light-sensitive material.

Comparative Example 2

A mixed solution of 60 g of butyl methacrylate, 40 g of Monomer M-1 and 200 g of toluene was heated at 75° C. while stirring under a nitrogen stream, to which 1.0 g of A.I.B.N. was added, followed by subjecting the mixture to reaction for 8 hours, thus obtaining a polymer in the form of a solution in toluene.

Then, the procedure of Example 1 was repeated except using 5 g of the above described polymer (as solid) instead of 5 g of the latex grains (L-1) to prepare an electrophotographic light-sensitive material.

These light-sensitive materials were then subjected to evaluation of the electrostatic characteristics and reproduced image quality, in particular, under ambient conditions of 30° C. and 80% RH. Furthermore, when using these light-sensitive materials as a master plate A for offset printing, the oil-desensitivity of the photoconductive layer in terms of a contact angle of the photoconductive layer with water after oil-desensitization and the printing performance in terms of a stain resistance and printing durability.

The image quality and printing performance were evaluated using a lithographic printing plate obtained by subjecting the light-sensitive material to exposure and development by means of an automatic plate making machine, ELP 404 V (-commercial name-, made by Fuji Photo Film Co., Ltd.) using a developing agent, ELP-T (-commercial name-, made by Fuji Photo Film Co., Ltd.) to form an image and etching by means of an etching processor using an oil-desensitizing solution, ELP-EX (-commercial name-, made by Fuji Photo Film Co., Ltd.). As a printing machine, Oliver 52 (-commercial name-, made by Sakurai Seisakujo KK) was used.

The results are shown in Table 3:

TABLE 3

| | Example 1 | Comparative Example 1 | Comparative Example 2 |
|---|---|---|---|
| Electrostatic Characteristics[1] | | | |
| Vo (−V) | 555 | 545 | 540 |
| DRR (%) | 87 | 89 | 85 |
| $E_{1/10}$ (lux · sec) | 9.8 | 10.5 | 9.4 |
| Image Quality[2] | | | |
| I: (20° C., 65%) | good | good | good |
| II: (30° C., 80%) | good | good | good |
| Contact Angle with Water[3] (degrees) | 7° | 35–40° large dispersion | 10° |
| Background stain[4] | | | |
| I | no | yes | no |
| II | no | marked | no |
| Printing Durability[5] | no stain even after 10000 prints | marked background stain from printing start | background stain after 5000 prints |

The characteristic item described in Table 3 are evaluated as follows:

(1) Electrostatic Characteristics

Each of the light-sensitive materials was negatively charged to a surface potential Vo (−V: negatively charged) by corona discharge at a voltage of 6 kV for 20 seconds in a dark room at a temperature of 20 ° C. and relative humidity of 65% using a paper analyzer (Paper Analyzer Sp-428 -commercial name- manufacture by Kawaguchi Denki KK) and after allowed to stand for 10 seconds, the surface potential $V_{10}$ was measured. Then, the sample was further allowed to stand in the dark room as it was for 60 seconds to measure the surface potential $V_{70}$, thus obtaining the retention of potential after the dark decay for 60 seconds, i.e., dark decay retention ratio (DRR (%)) represented by $(V_{70}/V_{10})\times 100$ (%). Moreover, the surface of the photoconductive layer was negatively charged to −400 V by corona discharge, then irradiated with visible ray at an illumination of 2.0 lux and the time required for dark decay of the surface potential ($V_{10}$) to 1/10 was measured to evaluate an exposure quantity $E_{1/10}$ (lux·Sec).

(2) Image quality

Each of the light-sensitive materials was allowed to stand for a whole day and night under the following ambient conditions and a reproduced image was formed thereon using an automatic printing plate making machine KLP-404 V (-commercial name-, made by Fuji Photo Film Co., Ltd., Ltd.) to visually evaluate the fog and image quality: (I) 20° C., 65% RH and (II) 30° C., 80% RH.

(3) Contact Angle with Water

Each of the light-sensitive materials was passed once through an etching processor using an oil-desensitizing solution ELP-EX (-commercial name-, made by Fuji Photo Film Co., Ltd.) 5 times diluted with distilled water to render the surface of the photoconductive layer oil-desensitized. On the thus oil-desensitized surface was placed a drop of 2 μl of distilled water and the contact angle formed between the surface and water was measured by a goniometer.

(4) Background Stain of Print

Each of the light-sensitive materials was processed by an automatic printing plate making machine ELP-404 to form a toner image and subjected to oil-desensitization under the same conditions as in the above described item (3). The resulting printing plate was mounted, as an offset master, on an offset printing machine, Oliver 52 (-commercial name- made by Sakurai Seisakujo KK) and printing was carried out on fine papers to obtain 500 prints. All the prints thus obtained were subjected to visual evaluation of the background stains, which was designated as Background Stain I of the print.

Background Stain II of the print was defined in an analogous manner to Background Stain I as defined above except that the moistening water during printing was 2-fold diluted. Case II corresponds to a printing carried out under severer conditions than Case I.

(5) Printing Durability

The printing durability was defined by the number of prints which could be obtained without forming background stains on the non-image areas of the print and meeting with any problem on the image quality of the image areas by processing each light-sensitive material and printing under the evaluation conditions corresponding to Background Stain II of the above described item (4). The more the prints, the better the printing durability.

As can be seen from Table 3, the light-sensitive material of the present invention exhibited excellent electrostatic characteristics of the photoconductive layer and gave a reproduced image free from background stains and excellent in image quality. This tells that the photoconductive material and binder resin are sufficiently combined and the added resin grains have no bad influences upon the electrostatic characteristics.

When the light-sensitive material of the present invention is used as a master plate for offset printing, the oil-desensitization of a non-image area can well proceed by the oil-desensitizing treatment and consequently, the non-image area is so rendered hydrophilic that the contact angle of the non-image area with water be smaller than 7°. Thus, it is found by observation of real prints that the printing plate precursor of the present invention can form a clear image and produce more than 10,000 clear prints without background stains.

In Comparative Example 1, on the other hand, the electrophotographic properties (image quality) were good, but in the oil-desensitizing processing as a master plate for offset printing, a non-image area was not sufficiently rendered hydrophilic, so that in real printing, background stains markedly occurred from the beginning in the print.

In Comparative Example 2, the polymer containing the monomer containing the functional group capable of forming carboxyl group through decomposition according to the present invention was used without fine granulation jointly with the same binder resin as that of Example 1. However, the effect of the polymer was not sufficient. This tells that the efficiency of rendering the non-image area hydrophilic as an offset master precursor was lower in this case as compared with the fine granular dispersion according to the present invention.

It will clearly be understood from these considerations that according to only the present invention, there can be obtained an electrophotographic photoreceptor capable of satisfying electrostatic properties as well as printing adaptability.

Examples 2 to 11

The procedure of Example 1 was repeated except using each of latex grains shown in Table 4 instead of the latex grains (L-1) obtained in Preparation Example 1, thus obtaining each of electrophotographic light-sensitive materials.

TABLE 4

| Examples | Latex Grains |
|---|---|
| 2 | L-3 |
| 3 | L-4 |
| 4 | L-5 |
| 5 | L-7 |
| 6 | L-8 |
| 7 | L-10 |
| 8 | L-11 |
| 9 | L-13 |
| 10 | L-14 |
| 11 | L-15 |

These light-sensitive materials were then subjected to evaluation of the electrostatic characteristics, reproduced image quality and printing performance.

The light-sensitive materials exhibited excellent electrophotographic properties and was capable of giving a number of clear prints free from background stains.

Example 12

A mixed solution of 50 g of Monomer M-2 and 200 g of methyl cellosolve was heated to 75° C. under a nitrogen stream, to which 0.5 g of A.I.B.N. was added, followed by reacting the mixture for 8 hours.

After cooling, the reaction mixture was subjected to a reprecipitation treatment in 1.5 l of hexane to obtain a white powder, which was then collected by filtration and dried. The yield of the white powder was 38 g.

A mixture of 38 g (as solid) of an acrylic resin, Dianar LR-009 (-commercial name-, manufactured by Mitsubishi Rayon KK), 5 g of the thus resulting white powder, 200 g of photoconductive zinc oxide (having the same maximum grain diameter and average grain diameter as that of Example 1), 0.02 g of Rose Bengal, 0.03 g of tetrabromophenol blue, 0.10 g of maleic anhydride and 300g of toluene was dispersed in a ball mill for 2 hours to prepare a light-sensitive coating composition.

The resulting light-sensitive coating composition was coated onto a sheet of paper having been rendered electrically conductive to give a dry coverage of 25 g/m$^2$ by a wire bar coater, followed by drying at 110° C. for 1 minute. The thus coated paper was allowed to stand in a dark place at a temperature of 20° C. and a relative humidity of 65% for 24 hours to prepare an electrophotographic light-sensitive material.

This light-sensitive material was subjected to evaluation of the electrostatic characteristics, reproduced image quality and printing performance.

The light-sensitive material of the present invention exhibited excellent reproduced image quality and a small contact angle of a non-image area with water after etching, i.e. less than 5° . When the light-sensitive material was used for printing, there was no background stain from the start of printing and more than 10,000 prints could be obtained without occurrence of background stain.

As can be seen from the result of this example, the resin capable of forming carboxyl groups through decomposition according to the present invention could be adequately dispersed in a desired fine grain state by allowing the resin in the form of a powder, without fine grain formation, to contain in a zinc oxide light-sensitive layer forming composition and subjecting the resin powder-containing composition to a dispersing treatment using a ball mill.

Examples 13 to 18

The procedure of Example 12 was repeated except using resin powders having repeating units shown in the following Table 5 instead of the white powder used in Example 12, thus obtaining corresponding electrophotographic light-sensitive materials.

TABLE 5

| Example | Resin |
|---|---|
| 13 | 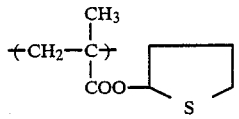 |
| 14 | 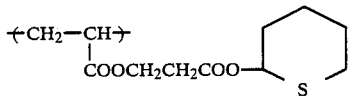 |
| 15 | 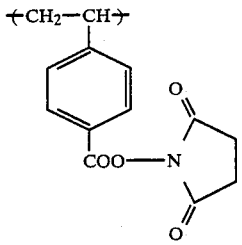 |

TABLE 5-continued

| Example | Resin |
|---|---|
| 16 | 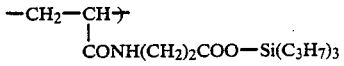 |
| 17 | 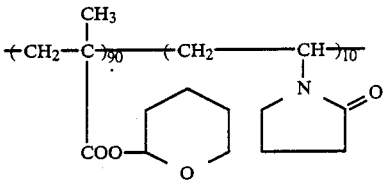 |
| 18 | 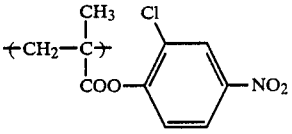 |

These light-sensitive materials were then subjected to evaluation of the electrostatic characteristics and printing performance, thus obtaining good results. In printing, in particular, more than 10,000 prints were obtained without occurrence of background stain.

Preparation Example 16 of Resin Grains

A mixed solution of 95 g of dodecyl methacrylate, 5 g of acrylic acid and 200 g of toluene was heated to 70° C. while stirring under a nitrogen stream, and 1.5 g of azobis(isobutyronitrile) (referred to as A.I.B.N.) was added thereto and reacted for 8 hours. To this reaction mixture were added 12 g of glycidyl methacrylate, 1 g of t-butylhydroquinone and 0.8 g of N,N-dimethyldodecylamine, followed by allowing the mixture to react at 100° C. for 15 hours (Dispersed Resin II).

A mixture of 8.0 g (as solid content) of Dispersed Resin II, 35 g of the monomer (M-1), 15 g of methyl methacrylate, 1.0 g of diethylene glycol dimethacrylate and 250 g of n-heptane was heated to 60° C. while stirring under a nitrogen stream, to which 0.3 g of 2,2'-azobis(isovaleronitrile) (referred to as A.I.V.N.) was then added, followed by reaction for 6 hours.

After passage of 20 mninutes from the addition of the initiator (A.I.V.N.), the homogeneous solution became slightly opaque, the reaction temperature being raised to 90° C. After cooling, the reaction product was passed through a nylon cloth of 200 mesh to obtain a white dispersion, as a latex with an average grain diameter of 0.25 μm.

Preparation Examples 17 to 26 of Resin Grains

The procedure of Preparation Example 6 was repeated except using monomers as shown in Table 6 instead of Monomer M-1 to prepare resin grains.

TABLE 6

| Preparation Examples | Monomers | Grain Diameter of Grains (μm) |
|---|---|---|
| 17 | 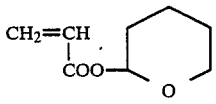 M-2 | 0.3 |

TABLE 6-continued

| Preparation Examples | Monomers | Grain Diameter of Grains (μm) |
|---|---|---|
| 18 | 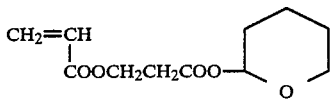 M-5 | 0.25 |
| 19 | 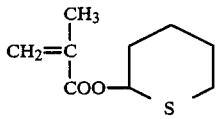 M-15 | 0.25 |
| 20 | 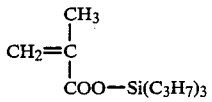 M-16 | 0.26 |
| 21 | 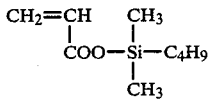 M-17 | 0.25 |
| 22 | 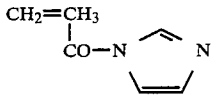 M-11 | 0.3 |
| 23 | 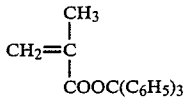 M-18 | 0.24 |
| 24 | 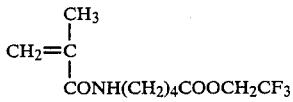 M-19 | 0.28 |
| 25 | 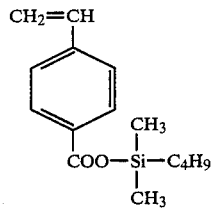 M-20 | 0.25 |
| 26 | 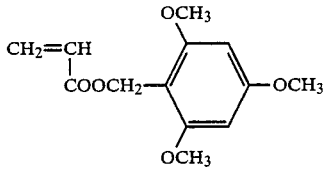 M-21 | 0.20 |

Preparation Example 27 of Resin Grains

A mixture of 31.5 g of ethylene glycol, 51.8 g of phthalic anhydride, 6.0 g of methacrylic acid, 10 g of trichloroethylene and 0.7 g of p-toluenesulfonic acid was heated and reacted for 6 hours in such a manner that the reaction temperature was raised from 107° C. to 150° C. in 6 hours, while removing water byproduced by the reaction by the Dean-Stark method to obtain Dispersed Resin III.

A mixture of 3 g (as solid content) of this Dispersed Resin III, 30 g of Monomer 14, 0.03 g of 1,6hexanediol diacrylate and 150 g of ethyl acetate was heated at 60° C. under a nitrogen stream, to which 0.05 g of A.I.V.N. was added, followed by reacting the mixture for 4 hours to obtain a white dispersion.

After cooling, the reaction product was passed through a nylon cloth of 200 mesh to obtain a dispersion with an average grain diameter of 0.3 μm.

Preparation Example 28 of Resin Grains

A mixture of 7.5 g of Dispersed Resin II, 40 g of the following monomer M-22, 10 g of styrene, 1.0 g of divinylbenzene and 300 g of n-octane was heated to 50° C. under a nitrogen stream, to which 0.5 g (as solid content) of n-butyllithium was added, followed by reacting the mixture for 6 hours to obtain a white dispersion with an average grain diameter of 0.17 μm.

Monomer M-22

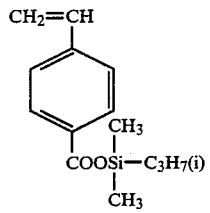

Preparation Example 29 of Resin Grains

A mixed solution of 20 g of Monomer M-1, 0.5 g of diethylene glycol dimethacrylate and 100 g of tetrahydrofuran was heated to 75° C. under a nitrogen stream, to which 0.2 g of A. I. B. N. was added, followed by subjecting the mixture to reaction for 6 hours.

After cooling, the reaction product was subjected to a reprecipitation treatment in 500 ml of methanol to obtain a white product, which was then collected by filtering and dried. The yield was 16 g.

Example 19

A mixture of 200 g of photoconductive zinc oxide, 40 g of (ethyl methacrylate/acrylic acid) copolymer (weight component ratio 97/3, weight average molecular weight 63,000), 8 g (as solid content) of the resin grains obtained in Preparation Example 16, 0.06 g of Rose Bengal, 0.20 g of phthalic anhydride and 300 g of toluene was ball milled for 2 hours. The thus resulting light-sensitive layer forming dispersion was applied to a paper rendered electrically conductive to give an adhered quantity on dry basis of 25 g/m$^2$ by a wire bar coater, followed by drying at 110° C. for 30 seconds. The thus coated paper was then allowed to stand in a dark place at a temperature of 20° C. and a relative humidity of 65% for 24 hours to prepare an electrophotographic light-sensitive material.

Comparative Example 3

The procedure of Example 19 was repeated except not using 8 g (as solid content) of the resin grains obtained in Preparation Example 16 to prepare an electrophotographic light-sensitive material.

Comparative Example 4

A mixed solution of 15 g of methyl methacrylate, 35 g of Monomer M-1 and 100 g of toluene was heated to 75° C. under a nitrogen stream, to which 0.5 g of A.I.B.N. was added, followed by reacting the mixture for 8 hours to obtain a copolymer solution.

Then, 200 g of photoconductive zinc oxide, 40 g of an ethyl methacrylate-acrylic acid copolymer (weight component ratio 97/3, weight average molecular weight 63,000), 8 g (as solid content) of the above described copolymer 0.06 g of Rose Bengal, 0.20 g of phthalic anhydride and 300 g of toluene were mixed and subjected to a dispersing treatment in a ball mill for 2 hours. The thus resulting light-sensitive layer forming composition was processed in an analogous manner to Example 19 to prepare an electrophotographic light-sensitive material.

These light-sensitive materials were then subjected to evaluation of the electrostatic characteristics and reproduced image quality, in particular, under ambient conditions of 30° C. and 80% RH. Furthermore, when using these light-sensitive materials as a master plate A for offset printing, the oil-desensitivity of the photoconductive layer in terms of a contact angle of the photoconductive layer with water after oil-desensitization and the printing performance in terms of a stain resistance and printing durability.

The image quality and printing performance were evaluated using a lithographic printing plate obtained by subjecting the light-sensitive material to exposure and development by means of an automatic plate making machine, ELP 404 V (-commercial name-, made by Fuji Photo Film Co., Ltd.) using a developing agent, ELP-T (-commercial name-, made by Fuji Photo Film Co., Ltd.) to form an image and etching by means of an etching processor using an oil-desensitizing solution, ELP-EX (-commercial name-, made by Fuji Photo Film Co., Ltd.). As a printing machine, Oliver 52 (-commercial name-, made by Sakurai Seisakujo KK) was used.

The results are shown in Table 7:

TABLE 7

| | Example 19 | Comparative Example 3 | Comparative Example 4 |
|---|---|---|---|
| Electrostatic Characteristics | | | |
| Vo (−V) | 555 | 565 | 550 |
| DRR (%) | 88 | 90 | 83 |
| $E_{1/10}$ (lux · sec) | 9.5 | 9.4 | 13.0 |
| Image Quality | | | |
| I: (20° C., 65%) | good | good | good |
| II: (30° C., 80%) | good | background stains, $D_M$* lowered, disappearance of fine lines | good dis-appearance of fine lines |
| Contact Angle with Water (degrees) | 8° | 25–30° large dispersion | 10° |
| Background stain | | | |
| I | no | yes | no |
| II | no | marked | no |
| Printing Durability | no stain even after 10000 prints | marked background stain from printing start | background stain after 7000 prints |

Note:
*DM image density

The characteristic item described in Table 7 are evaluated in an analogous manner to Example 1.

As can be seen from Table 7, the light-sensitive material of the present invention exhibited excellent electrostatic characteristics of the photoconductive layer and gave a reproduced image free from background stains and excellent in image quality. This tells that the photoconductive material and binder resin are sufficiently adsorbed and the added resin grains have no bad influences upon the electrostatic characteristics.

When the light-sensitive material of the present invention is used as a master plate for offset printing, the oil-desensitization of a non-image area can well proceed by the oil-desensitizing treatment of one pass and consequently, the non-image area is so rendered hydrophilic that the contact angle of the non-image area with water be smaller than 8°. Thus, it is found by observation of real prints that the printing plate precursor of the present invention can form a clear image and produce more than 10,000 clear prints without background stains.

In Comparative Example 3, on the other hand, the electrophotographic properties (image quality) were good, but in the oil-desensitizing processing as a master plate for offset printing, a non-image area was not sufficiently rendered hydrophilic, so that in real printing, background stains markedly occurred from the beginning in the print.

In Comparative Example 4, the electrophotographic properties, in particular, photosensitivity ($E_{1/10}$) was lowered and there was also found disappearance of fine lines of an image area under ambient conditions of 30° C. and 80% RH in a real reproduced image. When the light-sensitive material was used as an offset master through an oil-desensitizing treatment, background stains occurred in non-image areas after printing about 7000 prints.

It will clearly be understood from these considerations that according to only the present invention, there can be obtained an electrophotographic photoreceptor capable of satisfying electrostatic properties as well as printing adaptability.

Examples 20 to 30

The procedure of Example 19 was repeated except using 10 g of each of resin grains shown in Table 8 in place of the resin grains obtained in Preparation Example 16 of Resin Grains to obtain each electrophotographic light-sensitive material.

TABLE 8

| Examples | Resin Grains |
|---|---|
| 20 | Preparation Example 17 |
| 21 | 18 |
| 22 | 19 |
| 23 | 20 |
| 24 | 21 |
| 25 | 22 |
| 26 | 23 |
| 27 | 25 |
| 28 | 26 |
| 29 | 27 |
| 30 | 28 |

These light-sensitive materials were then subjected to evaluation of the electrostatic characteristics, reproduced image quality and printing performance.

All the light-sensitive materials exhibited excellent electrophotographic properties and were capable of giving a number of clear prints free from background stains.

Example 31

A mixture of 10 g of the powder obtained in Preparation Example 29 of Resin Grains, 1.8 g of a dodecyl methacrylate-acrylic acid copolymer (weight component ratio 95/5) and 100 g of toluene was dispersed for 56 hours in a ball mill to obtain a latex with an average grain size of 0.35 μm.

Then, the procedure of Example 19 was repeated except using 8 g (as solid content) of the above described resin grains instead of the resin grains obtained in Preparation Example 16 to prepare a light-sensitive material.

This light-sensitive material was subjected to evaluation of the electrostatic characteristics, reproduced image quality and printing performance in an analogous manner to Example 19.

The light-sensitive material of the present invention exhibited excellent reproduced image quality and a small contact angle of a non-image area with water after etching, i.e. less than 6°. When the light-sensitive material was used for printing, there was no background stain from the start of printing and more than 10,000 prints could be obtained without occurrence of background stain.

Preparation Example 30 of Resin Grains

A mixed solution of 95 g of dodecyl methacrylate, 5 g of acrylic acid and 200 g of toluene was heated to 70° C. while stirring under a nitrogen stream, and 1.5 g of azobis(isobutyronitrile) (referred to as A. I. B. N.) was added thereto and reacted for 8 hours. To this reaction mixture were added 12 g of glycidyl methacrylate, 1 g of t-butylhydroquinone and 0.8 g of N,N-dimethyldodecylamine, followed by allowing the mixture to react at 100° C. for 15 hours (Dispersed Resin IV).

A mixture of 8.5 g (as solid content) of Dispersed Resin IV, 35 g of the following monomer (M-23), 10 g of 2-cyanoethyl methacrylate and 250 g of n-heptane was heated to 60° C. while stirring under a nitrogen stream, to which 0.3 g of 2,2'-azobis (isovaleronitrile)(-referred to as A. I. V. N.) was then added, followed by reaction for 6 hours.

After passage of 20 minutes from the addition of the initiator (A. I. V. N.), the homogeneous solution became slightly opaque, the reaction temperature being raised to 90° C. After cooling, the reaction product was passed through a nylon cloth of 200 mesh to obtain a white dispersion, as a latex with an average grain diameter of 0.25 μm.

Monomer 23

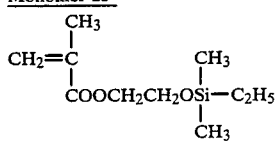

Preparation Examples 31 to 42 of Resin Grains

The procedure of Preparation Example 30 was repeated except using monomers in Table 9 instead of Monomer M-23 obtained in Preparation Example 30.

TABLE 9

| Preparation Examples | | Monomer | Average Grain Diameter (μm) |
|---|---|---|---|
| 31 | M-24 | 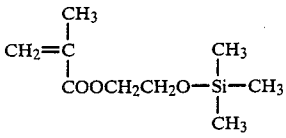 | 0.35 |
| 32 | M-25 | 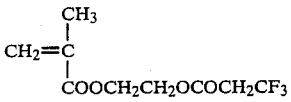 | 0.40 |
| 33 | M-26 | 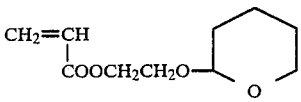 | 0.45 |
| 34 | M-27 | 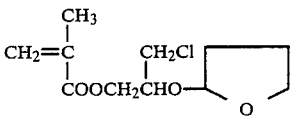 | 0.38 |
| 35 | M-28 | 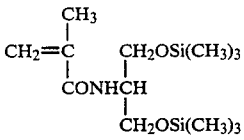 | 0.35 |

TABLE 9-continued

| Preparation Examples | Monomer | Average Grain Diameter (μm) |
|---|---|---|
| 36 | M-29 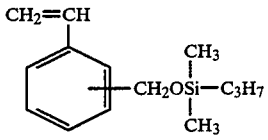 | 0.28 |
| 37 | M-30 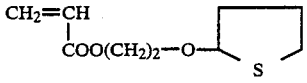 | 0.34 |
| 38 | M-31 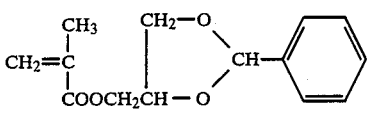 | 0.25 |
| 39 | M-32 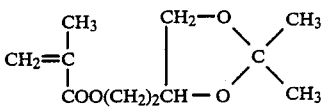 | 0.23 |
| 40 | M-33 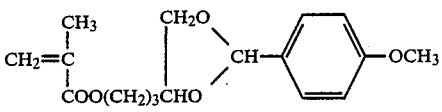 | 0.21 |
| 41 | M-34 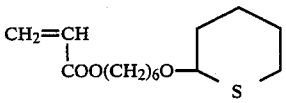 | 0.30 |
| 42 | M-35 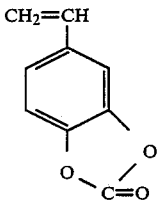 | 0.29 |

Preparation Example 43 of Resin Grains

A mixed solution of 95 g of dodecyl methacrylate, 50 g of isopropyl alcohol and 150 g of toluene was heated to 70° C. while stirring under a nitrogen stream, to which 5 g of 2,2'-azobis(4-cyanovaleric acid) (referred to as A. C. V.) was added, followed y reacting the mixture for 8 hours. This mixed solution was subjected to a reprecipitation treatment in 1.5 l of methanol and the precipitate (resin) was dried under reduced pressure at 40° C.

A mixture of 80 g of this resin, 10 g of glycidyl methacrylate, 0.7 g of N,N-dimethyldodecylamine, 1 g of t-butylhydroquinone and 200 g of toluene was heated at 95° C. to form a homogeneous solution and stirred for 48 hours as it was. The reaction product was then subjected to a reprecipitation treatment in 1.2 l of methanol and the precipitate was dried at 30° C. under reduced pressure to obtain Dispersed Resin V.

A mixture of 10 g of Dispersed Resin V, 50 g of the following monomer M-36, 0.4 g of divinylbenzene and 280 g of n-octane was heated at 60° C. under a nitrogen stream to form a homogeneous solution, to which 0.04 g of A. I. V. N. was then added, followed by reacting the mixture for 5 hours to obtain a white dispersion. After cooling, the reaction product was passed through a nylon cloth of 200 mesh, thus obtaining a dispersion with an average grain diameter of 0.25 μm.

Monomer-36

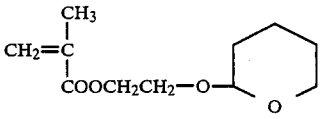

Preparation Examples 44 to 52 of Resin Grains

The procedure of Preparation Example 43 was repeated except using monomers and crosslinking monomers shown in Table 10 instead of Monomer M-36 and the divinylbenzene used in Preparation Example 43, thus obtaining resin grains.

TABLE 10

| Preparation Examples | Monomer: | | Crosslinking Monomer | Amount of Crosslinking Monomer (g) | Average Grain Diameter (μm) |
|---|---|---|---|---|---|
| 44 | M-24 | | ethylene glycol dimethacrylate | 0.5 | 0.28 |
| 45 | M-37 | $CH_2{=}C(CH_3)COO(CH_2)_2OCOCH(CF_3)_2$ | diethylene glycol dimethacrylate | 0.6 | 0.30 |
| 46 | M-38 | 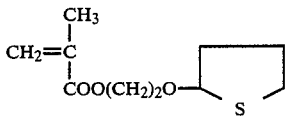 | trimethylolpropane triacrylate | 0.6 | 0.32 |
| 47 | M-39 | 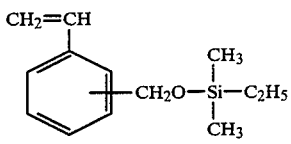 | divinylbenzene | 0.3 | 0.20 |
| 48 | M-30 | | ethylene glycol diacrylate | 0.3 | 0.25 |
| 49 | M-40 | 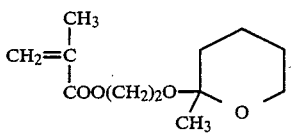 | IPS-22GA* | 0.5 | 0.22 |
| 50 | M-31 | | polyethylene glycol No. 400 dimeth-acrylate** | 0.6 | 0.18 |
| 51 | M-41 | $CH_2{=}C(CH_3)COOCH_2CH(CH_3)CH_2Si(CH_3)_3$ | vinyl methacrylate | 0.8 | 0.20 |
| 52 | M-40 | | allyl methacrylate | 1.0 | 0.15 |

Note:
*commercial name, made by Okamura Seiyu KK
**commercial name, made by Shin-Nakamura Kagaku KK Preparation Example 53 of Resin Grains A mixture of 7.5 g of Dispersed Resin V, 45 g of the following monomer M-42, 5 g of styrene, 1.0 g of divinylbenzene and 300 g of n-octane was heated to 50° C. under a nitrogen stream, to which 0.5 g (as solid content) of n-butyllithium was added, followed by reacting the mixture for 6 hours to obtain a white dispersion with an average grain diameter of 0.15 μm.

Monomer M-42

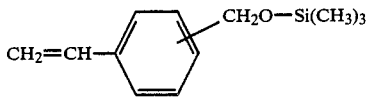

Preparation Example 54 of Resin Grains

A mixed solution of 20 g of Monomer M-23, 0.5 g of diethylene glycol dimethacrylate and 100 g of tetrahydrofuran was heated to 75° C. under a nitrogen stream, to which 0.2 g of A. I. B. N. was added, followed by subjecting the mixture to reaction for 6 hours.

After cooling, the reaction product was subjected to a reprecipitation treatment in 500 ml of methanol to obtain a white product, which was then collected by filtering and dried. The yield was 15 g.

EXAMPLE 32

A mixture of 200 g of photoconductive zinc oxide, 40 g of (ethyl methacrylate/acrylic acid) copolymer (weight component ratio 97/3, weight average molecular weight 63,000), 8 g (as solid content) of the resin grains obtained in Preparation Example 30, 0.06 g of Rose Bengal, 0.20 g of phthalic anhydride and 300 g of toluene was ball milled for 2 hours. The thus resulting light-sensitive layer forming dispersion was applied to a paper rendered electrically conductive to give an adhered quantity on dry basis of 25 g/m$^2$ by a wire bar coater, followed by drying at 110° C. for 30 seconds. The thus coated paper was then allowed to stand in a dark place at a temperature of 20° C. and a relative humidity of 65% for 24 hours to prepare an electrophotographic light-sensitive material.

Comparative Example 5

The procedure of Example 32 was repeated except not using 8 g (as solid content) of the resin grains obtained in Preparation Example 30 to prepare an electrophotographic light-sensitive material.

Comparative Example 6

A mixed solution of 15 g of ethyl methacrylate, 35 g of Monomer M-23 and 100 g of toluene was heated to 75° C. under a nitrogen stream, to which 0.5 g of A. I. B. N. was added, followed by reacting the mixture for 8 hours to obtain a copolymer solution.

Then, 200 g of photoconductive zinc oxide, 40 g of an ethyl methacrylate-acrylic acid copolymer (weight component ratio 85/15, weight average molecular weight 63,000), 8 g (as solid content) of the above described copolymer, 0.06 g of Rose Bengal, 0.20 g of phthalic anhydride and 300 g of toluene were mixed and subjected to a dispersing treatment in a ball mill for 2 hours. The thus resulting light-sensitive layer forming composition was processed in an analogous manner to Example 32 to prepare an electrophotographic light-sensitive material.

These light-sensitive materials were then subjected to evaluation of the electrostatic characteristics and reproduced image quality, in particular, under ambient conditions of 30° C. and 80% RH. Furthermore, when using these light-sensitive materials as a master plate A for offset printing, the oil-desensitivity of the photoconductive layer in terms of a contact angle of the photoconductive layer with water after oil-desensitization and the printing performance in terms of a stain resistance and printing durability.

The image quality and printing performance were evaluated using a lithographic printing plate obtained by subjecting the light-sensitive material to exposure and development by means of an automatic plate making machine, ELP 404 V (-commercial name-, made by Fuji Photo Film Co., Ltd.) using a developing agent, ELP-T (-commercial name-, made by Fuji Photo Film Co., Ltd.) to form an image and etching by means of an etching processor using an oil-desensitizing solution, ELP-EX (-commercial name-, made by Fuji Photo Film Co., Ltd.). As a printing machine, Oliver 52 (-commercial name-, made by Sakurai Seisakujo KK) was used.

The results are shown in Table 11:

TABLE 11

| | Example 30 | Comparative Example 5 | Comparative Example 6 |
|---|---|---|---|
| Electrostatic Characteristics | | | |
| Vo (−V) | 555 | 470 | 550 |
| DRR (%) | 88 | 75 | 83 |
| $E_{1/10}$ (lux · sec) | 9.5 | 8.0 | 13.0 |
| Image Quality | | | |
| I: (20° C., 65%) | good | $D_M$ lowered | good |
| II: (30° C., 80%) | good | background stains $D_M$ lowered, disappearance of fine lines | disappearance of fine lines |
| Contact Angle with Water (degrees) | 10° | 25–30° large dispersion | 12° |
| Background stain | | | |
| I | no | yes | no |
| II | no | marked | no |
| Printing Durability | no stain even after 10000 prints | marked background stain from printing start | background stains after 7000 prints |

The characteristics item described in Table 11 are evaluated in an analogous manner to Example 1. As can be seen from Table 11, the light-sensitive material of the present invention exhibited excellent electrostatic characteristics of the photoconductive layer and gave a reproduced image free from background stains and excellent in image quality. This tells that the photoconductive material and binder resin are sufficiently adsorbed and the added hydrophilic resin grains have no bad influences upon the electrostatic characteristics.

When the light-sensitive material of the present invention is used as a master plate for offset printing, the oil-desensitizing processing can well be accomplished by one passage through a processor and consequently, a non-image area is so rendered hydrophilic that the contact angle of the non-image area with water be smaller than 10°. Thus, it is found by observation of real prints that the printing plate precursor of the present invention can form a clear image and produce more than 10,000 clear prints without background stains.

In comparative Example 5, on the other hand, the electrophotographic properties (image quality) were good, but in the oil-desensitizing processing as a master plate for offset printing, a non-image area was not sufficiently rendered hydrophilic, so that in real printing, background stains markedly occurred from the beginning in the print.

In Comparative Example 6, the electrophotographic properties, in particular, photosensitivity ($E_{1/10}$) was lowered and there was also found disappearance of fine lines of an image area under ambient conditions of 30° C. and 80% RH in a real reproduced image. When the light-sensitive material was used as an offset master through an oil-desensitizing treatment, background stains occurred in non-image areas after printing about 7000 prints.

It will clearly be understood from these considerations that according to only the present invention, there can be obtained an electrophotographic photoreceptor capable of satisfying electrostatic properties as well as printing adaptability.

EXAMPLES 33 TO 43

The procedure of Example 32 was repeated except using 10 g (as solid content) of each of the resin grains shown in Table 12 instead of the resin grains obtained in Preparation Example 30, thus obtaining each of electrophotographic light-sensitive materials.

TABLE 12

| Examples | Resin Grains |
|---|---|
| 33 | Preparation Example 31 |
| 34 | 33 |
| 35 | 34 |
| 36 | 36 |
| 37 | 38 |
| 38 | 40 |
| 39 | 41 |
| 40 | 44 |
| 41 | 45 |
| 42 | 46 |
| 43 | 49 |
| 44 | 51 |

TABLE 12-continued

| Examples | Resin Grains |
|---|---|
| 45 | 53 |

These light-sensitive materials were then subjected to evaluation of the electrostatic characteristics, reproduced image quality and printing performance.

The light-sensitive materials exhibited excellent electrophotographic properties and was capable of giving a number of clear prints free from background stains.

EXAMPLE 46

A mixture of 10 g of the resin powder obtained by Preparation Example 54, 1.8 g of (dodecyl methacrylate/acrylic acid) copolymer (weight component ratio 95/5) and 100 g of toluene was dispersed for 56 hours in a ball mill to obtain a dispersion, i.e., latex with an average grain diameter of 0.33 μm.

A light-sensitive material was prepared in an analogous manner to Example 32 except using 8 g of the thus resulting resin grains (as solid content) instead of the grains obtained in Preparation Example 30 and subjected to measurement of the electrostatic characteristics, image quality and printing performances. The image quality was good and the contact angle of non-image areas after etchings with water was small, i.e. 10°. In printing, there was found no background stain from the start of printing, nor background stain even after printing 10,000 prints.

EXAMPLE 47

A light-sensitive material was prepared in an analogous manner to Example 32 except using 8 g (as solid content) of the grains obtained in Preparation Example 39 instead of the resin grains obtained in Preparation Example 30.

When the resulting light-sensitive material was subjected to measurement of the electrostatic characteristics in an analogous manner to Example 32, there were Obtained Vo: --550 (V), DRR: 87% and $E_{1/10}$: 9.6 (lux.sec).

In addition, this light-sensitive material was subjected to plate making in an analogous manner to Example 32 using an automatic printing plate making machine ELP-404 V to prepare a precursor for an offset master, which was then immersed in an aqueous solution of boric acid (0.5 mol/l) for 30 seconds and passed once through an etching processor using an oil-desensitizing solution ELP-EX to render the photoconductive layer oil-desensitized, thus obtaining a lithographic printing plate precursor.

On the other hand, the light-sensitive material of Comparative Example 5 was subjected to the oil-desensitizing treatment in the same manner as described above.

When printing was carried out using each of the precursors prepared from the light-sensitive materials of the present invention and Comparative Example 5, the former produced more than 10000 clear image quality prints without occurrence of background stain from the start of printing, while the latter met with marked occurrence of background stains from the start of printing.

Preparation Example 55 of Resin Grains

A mixed solution of 95 g of dodecyl methacrylate, 5 g of acrylic acid and 200 g of toluene was heated to 70° C. while stirring under a nitrogen stream, and 1.5 g of azobis(isobutyronitrile) (referred to as A. I. B. N.) was added thereto and reacted for 8 hours. To this reaction mixture were added 12 g of glycidyl methacrylate, 1 g of t-butylhydroquinone and 0.8 g of N,N-dimethyldodecylamine, followed by allowing the mixture to react at 100° C. for 15 hours (Dispersed Resin VI).

A mixture of 9 g (as solid content) of Dispersed Resin VI, 40 g of the following monomer (M-43), 10 g of styrene and 250 g of n-octane was heated to 60° C. while stirring under a nitrogen stream, to which 0.3 g of 2,2'-azobis(isovaleronitrile) (referred to as A. I. V. N.) was then added, followed by reaction for 6 hours.

After passage of 20 minutes from the addition of the initiator (A. I. V. N.), the homogeneous solution became slightly opaque, the reaction temperature being raised to 90° C. After cooling, the reaction product was passed through a nylon cloth of 200 mesh to obtain a white dispersion, as a latex with an average grain diameter of 0.25 μm.

Monomer M-43

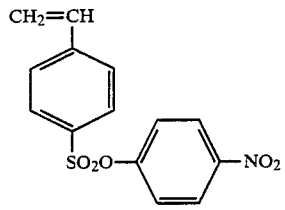

Preparation Examples 56 to 57

The procedure of Preparation Example 55 was repeated except using monomers shown in the following Table 13 instead of Monomer M-43 and 2-cyanoethyl methacrylate instead of the styrene to obtain resin grains.

TABLE 13

| Preparation Examples | | Monomer | Average Grain Diameter (μm) |
|---|---|---|---|
| 56 | M-44 | 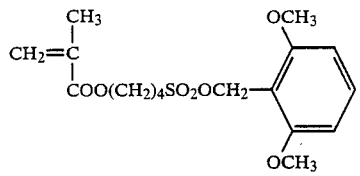 | 0.35 |

TABLE 13-continued

| Preparation Examples | | Monomer | Average Grain Diameter (μm) |
|---|---|---|---|
| 57 | M-45 | $CH_2=C(CH_3)COO(CH_2)_2SCOCH_2Cl$ | 0.33 |
| 58 | M-46 | $CH_2=C(CH_3)COO(CH_2)_2S-COOC_2H_5$ | 0.30 |
| 59 | M-47 | $CH_2=C(CH_3)COO(CH_2)_2S-Si(C_2H_5)_3$ | 0.29 |
| 60 | M-48 | $CH_2=C(CH_3)COO(CH_2)_3S-$ 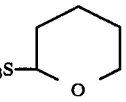 | 0.30 |
| 61 | M-49 | $CH_2=C(CH_3)COO(CH_2)_2NHCOOC(CH_3)_3$ | 0.29 |
| 62 | M-50 | $CH_2=CH-COO(CH_2)_2NHCOOCH_2-$ 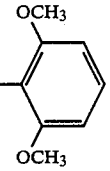 | 0.28 |
| 63 | M-51 | $CH_2=C(CH_3)COO(CH_2)_3N=CH-$ 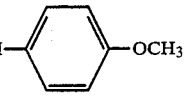 | 0.30 |
| 64 | M-52 | $CH_2=C(CH_3)COO(CH_2)_2OCO(CH_2)_4-$ 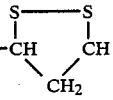 | 0.32 |
| 65 | M-53 | $CH_2=C(CH_3)COO(CH_2)_2-O-P(=O)(OC_2H_5)-O-Si(C_4H_9)(CH_3)_2$ | 0.40 |
| 66 | M-54 | $CH_2=C(CH_3)COO(CH_2)_4SO_2O-$ 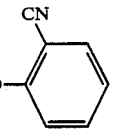 | 0.35 |
| 67 | M-55 | $CH_2=CH(CH_3)COO(CH_2)_2S-$ 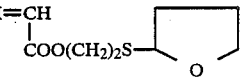 | 0.45 |

Preparation Example 68 of Resin Grains

A mixed solution of 95 g of dodecyl methacrylate, 50 g of isopropyl alcohol and 150 g of toluene was heated to 70° C. while stirring under a nitrogen stream, to which 5 g of 2,2'-azobis(4-cyanovaleric acid) referred to as A. C. V.) was added, followed by reacting the mixture for 8 hours. The mixed solution was subjected to a reprecipitation treatment in 1.5 l of methanol and the precipitate (resin) was dried under reduced pressure at 40° C.

A mixture of 80 g of this resin, 10 g of glycidyl methacrylate, 0.7 g of N,N- dimethyldodecylamine, 1 g of t-butylhydroquinone and 200 g of toluene was heated at 95° C. to form a homogeneous solution and stirred for 48 hours as it was. The reaction product was then subjected to a reprecipitation treatment in 1.2 l of methanol and the precipitate was dried at 30° C. under reduced pressure to obtain Dispersed Resin VII.

A mixture of 10 g of Dispersed Resin VII, 50 g of the monomer M-43, 0.4 g of divinylbenzene and 280 g of n-octane was heated at 60° C. under a nitrogen stream to form a homogeneous solution, to which 0.04 g of A. I. V. N. was then added, followed by reacting the mixture for 5 hours to obtain a white dispersion. After cooling, the reaction product was passed through a nylon cloth of 200 mesh, thus obtaining a dispersion with an average grain diameter of 0.25 μm.

Preparation Examples 69 to 80 of Resin Grains

The procedure of Preparation Example 68 was repeated except using monomers and crosslinking monomers shown in Table 14 instead of Monomer M-43 and the divinylbenzene used in Preparation Example 68, thus obtaining resin grains.

TABLE 14

| Preparation Example | Monomer | Crosslinking Monomer | Amount of Crosslinking Monomer (g) | Average Grain Diameter (μm) |
|---|---|---|---|---|
| 69 | M-44 | ethylene glycol dimethacrylate | 0.5 | 0.28 |
| 70 | M-45 | diethylene glycol dimethacrylate | 0.6 | 0.25 |
| 71 | M-46 | triethylene glycol diacrylate | 0.6 | 0.26 |
| 72 | M-47 | IPS-22GA* | 0.9 | 0.24 |
| 73 | M-56 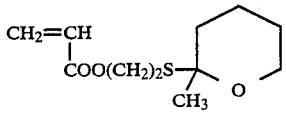 | ethylene glycol diacrylate | 0.5 | 0.25 |
| 74 | M-49 | polyethylene glycol No. 400 diacrylate** | 1.0 | 0.29 |
| 75 | M-57 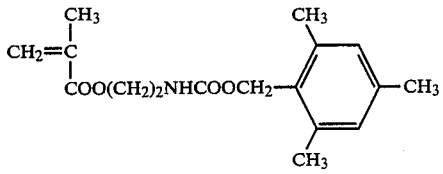 | vinyl methacrylate | 1.2 | 0.20 |
| 76 | M-51 | allyl methacrylate | 1.5 | 0.24 |
| 77 | M-52 | 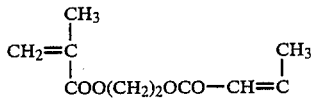 | 0.8 | 0.25 |
| 78 | M-53 | diethylene glycol dimethacrylate | 0.7 | 0.35 |
| 79 | M-58 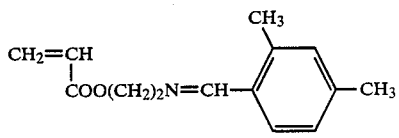 | ethylene glycol diacrylate | 0.5 | 0.21 |
| 80 | M-54 | vinyl adipate | 1.5 | 0.24 |

Note:
* and ** See Table 10.

Preparation Example 81 of Resin Grains

A mixture of 8.0 g of Dispersed Resin VII, 45 g of the following monomer M-59, 5 g of styrene, 1.0 g of divinylbenzene and 300 g of n-octane was heated to 50° C. under a nitrogen stream, to which 0.5 g (as solid content) of n-butyllithium was added, followed by reacting the mixture for 6 hours to obtain a white dispersion with an average grain diameter of 0.25 μm.

Monomer M-59

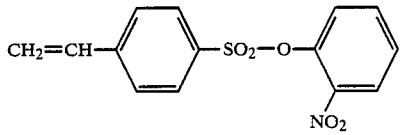

Preparation Example 82 of Resin Grains

A mixed solution of 20 g of Monomer M-43, 0.5 g of diethylene glycol dimethacrylate and 100 g of tetrahydrofuran was heated to 75° C. under a nitrogen stream, to which 0.2 g of A. I. B. N. was added, followed by subjecting the mixture to reaction for 6 hours.

After cooling, the reaction product was subjected to a reprecipitation treatment in 500 ml of methanol to obtain a white product, which was then collected by filtering and dried. The yield was 15 g.

EXAMPLE 48

A mixture of 200 g of photoconductive zinc oxide, 40 g of (ethyl methacrylate/acrylic acid) copolymer (weight component ratio 97/3, weight average molecular weight 63,000), 7 g (as solid content) of the resin grains obtained in Preparation Example 55, 0.06 g of Rose Bengal, 0.20 g of phthalic anhydride and 300 g of toluene was ball milled for 2 hours. The thus resulting light-sensitive layer forming dispersion was applied to a paper rendered electrically conductive to give an adhered quantity on dry basis of 25 g/m$^2$ by a wire bar coater, followed by drying at 110° C. for 30 seconds. The thus coated paper was then allowed to stand in a dark place at a temperature of 20° C. and a relative humidity of 65% for 24 hours to prepare an electrophotographic light-sensitive material.

Comparative Example 7

The procedure of Example 48 was repeated except not using 8 g (as solid content) of the resin grains obtained in Preparation Example 55 to prepare an electrophotographic light-sensitive material.

Comparative Example 8

A mixed solution of 15 g of methyl methacrylate, 35 g of Monomer M-43 and 100 g of toluene was heated to 75° C. under a nitrogen stream, to which 0.5 g of A. I. B. N. was added, followed by reacting the mixture for 8 hours to obtain a copolymer solution.

Then, 200 g of photoconductive zinc oxide, 40 g of an ethyl methacrylate-acrylic acid copolymer (weight component ratio 97/3, weight average molecular weight 63,000), 8 g (as solid content) of the above described copolymer, 0.06 g of Rose Bengal, 0.20 g of phthalic anhydride and 300 g of toluene were mixed and subjected to a dispersing treatment in a ball mill for 2 hours. The thus resulting light-sensitive layer forming composition was processed in an analogous manner to Example 48 to prepare an electrophotographic light-sensitive material.

These light-sensitive materials were then subjected to evaluation of the electrostatic characteristics and reproduced image quality, in particular, under ambient conditions of 30° C. and 80% RH. Further more, when using these light-sensitive materials as a precursor for an offset master A, the oil-desensitivity of the photoconductive layer in terms of a contact angle of the photoconductive layer with water after oil-desensitization and the printing performance in terms of a stain resistance and printing durability.

The image quality and printing performance were evaluated using a lithographic printing plate obtained by subjecting the light-sensitive material to exposure and development by means of an automatic plate making machine, ELP 404 V (-commercial name-, made by Fuji Photo Film Co., Ltd.) using a developing agent, ELP-T (-commercial name-, made by Fuji Photo Film Co., Ltd.) to form an image and etching by means of an etching processor using an oil-desensitizing solution, ELP-EX (-commercial name-, made by Fuji Photo Film Co., Ltd.). As a printing machine, Oliver 52 (-commercial name-, made by Sakurai Seisakujo KK) was used.

The results are shown in Table 15:

TABLE 15

| | Example 48 | Comparative Example 7 | Comparative Example 8 |
|---|---|---|---|
| Electrostatic Characteristics | | | |
| Vo (−V) | 540 | 565 | 500 |
| DRR (%) | 87 | 90 | 82 |
| $E_{1/10}$ (lux · sec) | 9.4 | 9.4 | 10.6 |
| Image Quality | | | |
| I: (20° C., 65%) | good | good | good |
| II: (30° C., 80%) | good | background stains $D_M$ lowered, disappearance of fine lines | disappearance of fine lines |
| Contact Angle with Water (degrees) | less than 10° | 25–30° large dispersion | 12° |
| Background stain | | | |
| I | no | yes | no |
| II | no | marked occurrence | no |
| Printing Durability | no stain even after 10000 prints | marked background stain from printing start | background stains after 7000 prints |

The characteristic item described in Table 15 are evaluated in an analogous manner to Example 1.

As can be seen from Table 15, the light-sensitive material of the present invention exhibited excellent electrostatic characteristics of the photoconductive layer and gave a reproduced image free from background stains and excellent in image quality. This tells that the photoconductive material and binder resin are sufficiently adsorbed and the added hydrophilic resin grains have no bad influences upon the electrostatic characteristics.

When the light-sensitive material of the present invention is used as a master plate for offset printing, the oil-desensitizing processing can well be accomplished by one passage through a processor even with a diluted oil-desensitizing solution and consequently, a non-image area is so rendered hydrophilic that the contact angle of the non-image area with water be smaller than 10°. Thus, it is found by observation of real prints that the printing plate precursor of the present invention can form a clear image and produce more than 10,000 clear prints without background stains.

In Comparative Example 7, on the other hand, the electrophotographic properties (image quality) were good, but in the oil-desensitizing processing as a master plate for offset printing, a non-image area was not sufficiently rendered hydrophilic, so that in real printing, background stains markedly occurred from the beginning in the print.

In Comparative Example 8, the electrophotographic properties, in particular, photosensitivity ($E_{1/10}$) was lowered and there was also found disappearance of fine lines of an image area under ambient conditions of 30° C. and 80% RH in a real reproduced image. When the light-sensitive material was used as an offset master through an oil-desensitizing treatment, background stains occurred in non-image areas after printing about 7000 prints.

It will clearly be understood from these considerations that according to only the present invention, there can be obtained an electrophotographic photoreceptor capable of satisfying electrostatic properties as well as printing adaptability.

Examples 49 to 60

The procedure of Example 48 was repeated except using 10 g (as solid content) of each of the resin grains shown in Table 16 instead of the resin grains obtained in Preparation Example 55, thus obtaining each of electrophotographic light-sensitive materials.

TABLE 16

| Examples | Resin Grains |
|---|---|
| 49 | Preparation Example 56 |
| 50 | 59 |
| 51 | 60 |
| 52 | 61 |
| 53 | 62 |
| 54 | 63 |
| 55 | 65 |
| 56 | 69 |
| 57 | 73 |
| 58 | 74 |
| 59 | 76 |
| 60 | 79 |

These light-sensitive materials were then subjected to evaluation of the electrostatic characteristics, reproduced image quality and printing performance in an analogous manner to Example 48.

The light-sensitive materials exhibited excellent electrophotographic properties and was capable of giving a number of clear prints free from background stains.

Example 61

A mixture of 10 g of the resin powder obtained by Preparation Example 81, 1.8 g of (dodecyl methacryate/acrylic acid) copolymer (weight component ratio 95/5) and 100 g of toluene was dispersed for 56 hours in a ball mill to obtain a dispersion, i.e., latex with an average grain diameter of 0.30 μm.

A light-sensitive material was prepared in an analogous manner to Example 48 except using 8 g of the thus resulting resin grains (as solid content) instead of the grains obtained in Preparation Example 55 and subjected to measurement of the electrostatic characteristics, image quality and printing performances in an analogous manner to Example 48. The image quality was good and the contact angle of non-image areas after etching with water was small, i.e. 10°. In printing, there was found no background stain from the start of printing, nor background stain even after printing 10,000 prints.

Example 62

A light-sensitive material was prepared in an analogous manner to Example 48 except using 8 g (as solid content) of the grains obtained in Preparation Example 58 instead of the resin grains obtained in Preparation Example 55.

When the resulting light-sensitive material was subjected to measurement of the electrostatic characteristics in an analogous manner to Example 48, there were obtained Vo: −530 (V), DRR: 88% and $E_{1/10}$): 9.5 (lux·sec).

In addition, this light-sensitive material was subjected to plate making in an analogous manner to Example 48 using an automatic printing plate making machine ELP-404 V to prepare a precursor for an offset master, which was then immersed in an aqueous solution of boric acid (0.5 mol/l) for 30 seconds and passed once through an etching processor using an oil-desensitizing solution ELP-EX to render the photoconductive layer oil-desensitized, thus obtaining a lithographic printing plate precursor.

On the other hand, the light-sensitive material of Comparative Example 7 was subjected to the oil-desensitizing treatment in the same manner as described above.

When printing was carried out using each of the precursors prepared from the light-sensitive materials of the present invention and Comparative Example 7, the former produced more than 10000 clear image quality prints without occurrence of background stain from the start of printing, while the latter met with marked occurrence of background stains from the start of printing.

Examples 63 and 64

The procedure of Example 48 was repeated except using resin grains shown in Table 17 instead of the resin grains obtained in Preparation Example 55.

TABLE 17

| Examples | Resin Grains |
|---|---|
| 63 | Preparation Example 64 |
| 64 | 77 |

When these light-sensitive materials were subjected to evaluation of the electrostatic characteristics and reproduced image quality in an analogous manner to Example 48, these all exhibited good electrostatic characteristics and reproduced image quality.

In addition, each of the light-sensitive materials was subjected to plate making in an analogous manner to Example 48 using an automatic printing plate making machine ELP-404 V to prepare a precursor for an offset master, which was then immersed in an aqueous solution of hydrazine hydrate (0.5 mol/l) for 30 seconds and passed once through an etching processor using an oil-desensitizing solution ELP-EX to render the photoconductive layer oil-desensitized, thus obtaining a lithographic printing plate precursor.

When printing was carried out using each of the precursors, all the precursors more than 10000 clear image quality prints without occurrence of background stains from the start of printing.

As apparent from the above described illustration, according to the present invention, there can be provided a lithographic printing plate precursor having very excellent printing performances.

Since in the present invention, the resin containing functional groups capable of forming polar groups or hydrophilic groups upon decomposition is converted into fine grains and used independently of a resin binder for photoconductive zinc oxide, such a phenomenon can be prevented during oil-desensitization of non-image areas that only the moiety of the above described functional group is strongly reacted with the oil-desensitizing solution and even if increasing the etching speed, the non-image areas can uniformly be rendered well oil-desensitized.

The functional groups of the above described resin grains present on non-image areas are gradually decomposed with the oil-desensitizing solution or dampening water during printing whereby to maintain good the hydrophilic property of the non-image areas throughout from the start of printing to the end thereof.

Furthermore, when using resin grains a part of which is crosslinked, the resin grains are not dissolved in the above described dampening water, so the precursor of the present invention provides a lithographic printing plate with a markedly improved printing durability and capable of being repeatedly used under good state.

What is claimed is:

1. An electrophotographic lithographic printing plate precursor comprising an electrically conductive support and at least one photoconductive layer, provided thereon, containing photoconductive zinc oxide and a binder resin, in which said photoconductive layer contains resin grains containing at least one polymeric component or repeating unit containing at least one functional group capable of producing at least one polar group through decomposition.

2. The electrophotographic lithographic printing plate precursor as claimed in claim 1, wherein the polar group is a hydrophilic group selected from the group consisting of carboxyl, hydroxyl, thiol, phosphono, amino and sulfo groups.

3. The electrophotographic lithographic printing plate precursor as claimed in claim 1, wherein at least a part of the functional group-containing resin is crosslinked.

4. The electrophotographic lithographic printing plate precursor as claimed in claim 1, wherein the resin grains have a maximum grain diameter of at most 10 $\mu$m and an average grain diameter of at most 1 $\mu$m.

5. The electrophotographic lithographic printing plate precursor as claimed in claim 1, wherein the resin grains are in a proportion of 0.1 to 50% by weight to 100 parts by weight of the photoconductive zinc oxide.

6. The electrophotographic lithographic printing plate precursor as claimed in claim 1, wherein the functional group-containing resin has a molecular weight of $10^3$ to $10^6$.

7. The electrophotographic lithographic printing plate precursor as claimed in claim 1, wherein the functional group-containing resin consists of a homopolymer or copolymer comprising the polar group-producing repeating units in a proportion of 1 to 95% by weight to the resin.

8. The electrophotographic lithographic printing plate precursor as claimed in claim 1, wherein the resin grains are obtained by any of dry process or wet process pulverization methods, polymer latex producing methods, dispersion methods, suspension polymerization methods and dispersion polymerization methods.

9. The electrophotographic lithographic printing plate precursor as claimed in claim 1, wherein the crosslinking is carried out by incorporating functional groups capable of effecting a crosslinking reaction into a polymer containing functional groups capable of producing polar groups through decomposition and subjecting the polymer containing both the functional groups to crosslinking by the use of a crosslinking agent or hardening agent or by a high molecular reaction.

10. The electrophotographic lithographic printing plate precursor as claimed in claim 9, wherein the high molecular reaction is carried out in the presence of a multifunctional monomer or oligomer containing at least two polymerizable functional groups to form crosslinkings among the molecules.

11. The electrophotographic lithographic printing plate precursor as claimed in claim 1, wherein the resin grains have an average grain diameter of same as or smaller than the maximum grain diameter of the photoconductive zinc oxide grains.

12. The electrophotographic lithographic printing plate precursor as claimed in claim 1, wherein the binder resin is at least one member selected from the group consisting of vinyl chloride/vinyl acetate copolymers, styrene/butadiene copolymers, styrene/methacrylate copolymers, methacrylate copolymers, acrylate copolymers, vinyl acetate copolymers, polyvinyl butyral, alkyd resins, silicone resins, epoxy resins, epoxy ester resins and polyester resins.

13. The electrophotographic lithographic printing plate precursor as claimed in claim 1, wherein the binder resin is in a proportion of 10 to 60 parts by weight to 100 parts by weight of the photoconductive zinc oxide.

14. The electrophotographic lithographic printing plate precursor as claimed in claim 1, wherein the photoconductive layer further contains at least one dye as a spectral sensitizer.

15. The electrophotographic lithographic printing plate precursor as claimed in claim 1, wherein the decomposition is carried out upon contact with an oil-desensitizing solution or damping water.

* * * * *